US007220146B2

(12) United States Patent
Miyazaki

(10) Patent No.: US 7,220,146 B2
(45) Date of Patent: May 22, 2007

(54) MINIATURIZATION FACILITATING PLUG CONNECTORS

(75) Inventor: Tatsuya Miyazaki, Tokyo (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/363,138

(22) Filed: Feb. 27, 2006

(65) Prior Publication Data

US 2006/0194475 A1 Aug. 31, 2006

(30) Foreign Application Priority Data

Feb. 28, 2005 (JP) ..... 2005-054896

(51) Int. Cl.
*H01R 9/05* (2006.01)

(52) U.S. Cl. ..... 439/579; 439/497; 439/402

(58) Field of Classification Search ..... 439/497, 439/578, 579, 402, 404, 901
See application file for complete search history.

(56) References Cited

U.S. PATENT DOCUMENTS

| | | | | |
|---|---|---|---|---|
| 4,027,941 | A | 6/1977 | Narozny | |
| 4,260,209 | A * | 4/1981 | Zell et al. | 439/443 |
| 4,406,512 | A | 9/1983 | Schell | |
| 4,641,904 | A * | 2/1987 | Kosugi et al. | 439/404 |
| 4,892,489 | A * | 1/1990 | Hirai | 439/497 |
| 5,964,620 | A * | 10/1999 | Takahashi et al. | 439/579 |
| 5,967,832 | A | 10/1999 | Ploehn | |
| 6,065,993 | A * | 5/2000 | Lai et al. | 439/402 |
| 6,190,196 | B1 * | 2/2001 | Kato | 439/493 |
| 6,193,545 | B1 | 2/2001 | Lee et al. | |
| 6,250,959 | B1 | 6/2001 | Yamaguchi et al. | |
| 6,309,243 | B1 * | 10/2001 | Tu et al. | 439/497 |
| 6,645,002 | B1 * | 11/2003 | Lee | 439/497 |
| 6,793,527 | B2 * | 9/2004 | Noro | 439/579 |
| 6,840,798 | B2 * | 1/2005 | Kobayashi | 439/497 |
| 2001/0036767 | A1 | 11/2001 | Igarashi | |
| 2003/0036304 | A1 | 2/2003 | Soubh | |
| 2003/0064615 | A1 | 4/2003 | Fogg et al. | |

FOREIGN PATENT DOCUMENTS

EP 0 385 020 5/1990

OTHER PUBLICATIONS

International Search Report in International Application No. PCT/US2006/007055.

* cited by examiner

*Primary Examiner*—Michael C. Zarroli
(74) *Attorney, Agent, or Firm*—Thomas D. Paulius

(57) ABSTRACT

Connectors to which cables are attached are provided. Included is a cable having a conductor covered with an insulator, the connector comprising a housing and a terminal held in the housing and connected to the conductor. Cable holders are arranged in the housing and hold a distal end portion of the cable. A shell is fitted in the housing to cover these members. The cable holders hold the cable in the housing, the housing including: fitting holes for fitting the cable holders, the shell including: through holes provided in a position opposed to the fitting holes, the cable holders having a double-legged or double-tined portion consisting of a pair of legs or tines for grasping the cables, such as by pinching or nipping, and a board portion or backbone for connecting the legs or tines together. The cable holders straddle and pinch the cable while the board portion is positioned in the through holes when fitted in the fitting holes via the through holes, thereby reducing size. Another advantage is preventing solder hardening of the wires, thereby further facilitating miniaturization.

20 Claims, 36 Drawing Sheets

(a)

(b)

MINIATURIZATION FACILITATING PLUG CONNECTORS

BACKGROUND OF THE INVENTION

The present invention relates to a connector for a plurality of cables. The connector provides electrical connection between the cables and a circuit board in a manner that fosters miniaturization and avoids undue stiffness of the cables at the connector.

Coaxial cables are known as cables for transmitting high-frequency signals in portable telephones, personal computers, and the like in order to transmit a volume of information. As shown in prior art FIGS. 37 and 38, a typical coaxial cable 300 is composed of a signal line 306 having a centrally located inner conductor 302 covered with an inner insulator 304, an outer conductor 308 consisting of a large number of spirally wound or braided electric wires and covering the signal line 306, and an outer insulator 310 covering the outer conductor 308.

Soldering methods are among the technologies available to connect a cable such as the coaxial cable 300 to a connector. As shown in FIG. 39, a known soldering method exposes the outer conductor 308 and the inner conductor 302 by stripping off the outer insulator 310 and the inner insulator 304, and the outer conductor 308 is twisted into a strand and then soldered between flat metal sheets (not shown). In this known soldering method, when soldering the coaxial cables to terminals, the solder can be "sucked up" by the outer conductor 308 through a phenomenon known as "solder wicking". In such a case, the outer conductor 308 becomes hard. Once the outer conductor 308 becomes hard, the coaxial cables are not flexible, and they thereby become difficult to wind or twist and/or difficult to arrange in a narrow space such as inside a portable telephone. Such difficulties make the coaxial cables inconvenient and inefficient and at times unsuitable for applications where increased miniaturization is an objective. Further, if extraordinary outer forces are imparted to the hardened portion, cracking of the hardened portion may be experienced.

As the types of connectors have diversified in recent years, connectors having a large number of terminals arranged in parallel have come into use. With such connectors, their large number of parallel terminals are connected to flat cables having a large number of coaxial cables. Connectors having such flat cables can be components of many devices or electronic instruments. For instance, in folding-type portable telephones, these types of connectors are used for transmitting signals between a liquid crystal screen and operational buttons on opposite sides of the device joined through a hinge. The portable telephone is folded by rotating one side to the other side but the cables typically are arranged in the hinge portion. When the hardening phenomenon due to soldering occurs at such hinge portion cable areas, a device such as a portable telephone becomes difficult to fold, the connector is not easily passed through a cable insertion-hole (not shown) at the hinge, and/or connection failure may be induced.

Meanwhile, the need for miniaturization of portable instruments has been increasing over the years, which means that the outer dimensions of connectors cannot be increased. Hence, problems such as those noted herein must be addressed without increasing the size of the device, and prior approaches have focused on improvements in connector components. Prior publications along these lines teach technologies for effecting solder connection between a connector and a coaxial cable or other such electric wire. These include Japanese Patent Publication No. JP 2000-260497 A, No. JP 11-260439 A and No. JP 11-260440 A.

SUMMARY OF THE INVENTION

Problems such as those noted above are addressed with advantageous results by the present invention, which has been made in view of the above circumstances. In this regard, it is an object of the present invention to provide a technique with which, in mounting coaxial cables to a connector, solder wicking to the coaxial cables is prevented thereby avoiding undesirable hardening of wires which are components of the coaxial cables, which is especially important for connectors that are ever increasingly miniaturized.

To attain the above object, the present invention adopts the following approach. A connector is provided to which a plurality of cables each having a conductor covered with an insulator are attached. The connector has a housing serving as the base of the connector, a terminal held in the housing and connected with the conductor of the cables, and cable holders are provided in the housing for holding at least a portion of the respective distal end portions of the coaxial cables and a shell fitted in the housing to cover terminals and other parts. The cable holders hold the cable between the housing, and the housing includes fitting holes for receiving the cable holders, the shell including through holes provided in a position opposed to the fitting holes when positioning the shell in the housing. The cable holders have a double-legged portion consisting of a pair of legs for pinching the cables and a backbone portion for connecting the legs, the cable holders holding the cables with the double-legged portion and the backbone portion by straddling and pinching each cable, and the backbone portion is thereby positioned within the through holes.

The connector of the present invention is provided with the fitting holes in the housing for fitting the cable holders and the through holes in the shell coaxial to the fitting holes. When the cable holders are fitted into the fitting holes via the through holes, the cable holders straddle and pinch the cables between the housing and the cable holders in a secure manner. Since the cable holders are contained in the housing, the cables are held in the housing without requiring any soldering thereof.

When the cable holders are fitted into the fitting holes via the through holes, the backbone portions of the respective cable holders are positioned in the through holes. Comparing this configuration with the prior approach where the cable holders are fitted into the fitting holes in the housing and then the housing is covered with the shell, where both the present invention and the prior approach are same in the length of the cable holders and in the amount of insertion to the fitting holes in the housing, the cable holders of the present invention can reduce the height of the connector by an amount of the backbone portion facing to the through holes in the shell.

According to an overall aspect or object of the present invention, the wires of an electrical connector can be prevented from hardening and the connector can be miniaturized. The invention finds special applications in plug connectors for miniaturized electronic equipment.

Other aspects, objects and advantages of the present invention will be understood from the following description according to the preferred embodiments of the present invention, specifically including stated and unstated combinations of the various features which are described herein, relevant information concerning which is shown in the accompanying drawings.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
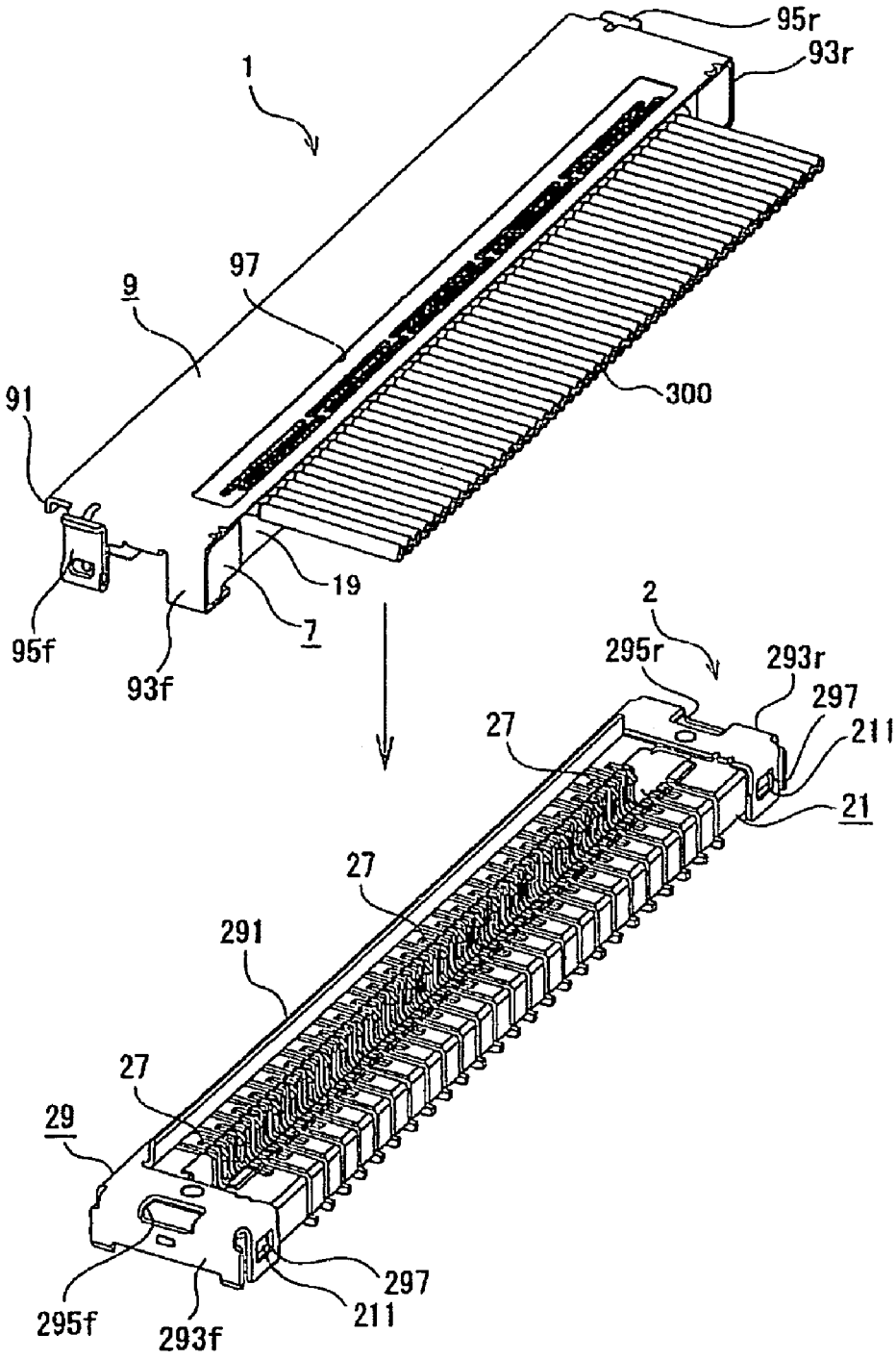
FIG. 1 is a perspective view showing, together with a mating connector, a connector according to the present invention in a state prior to its mounting to the mating connector.
Figure 2:
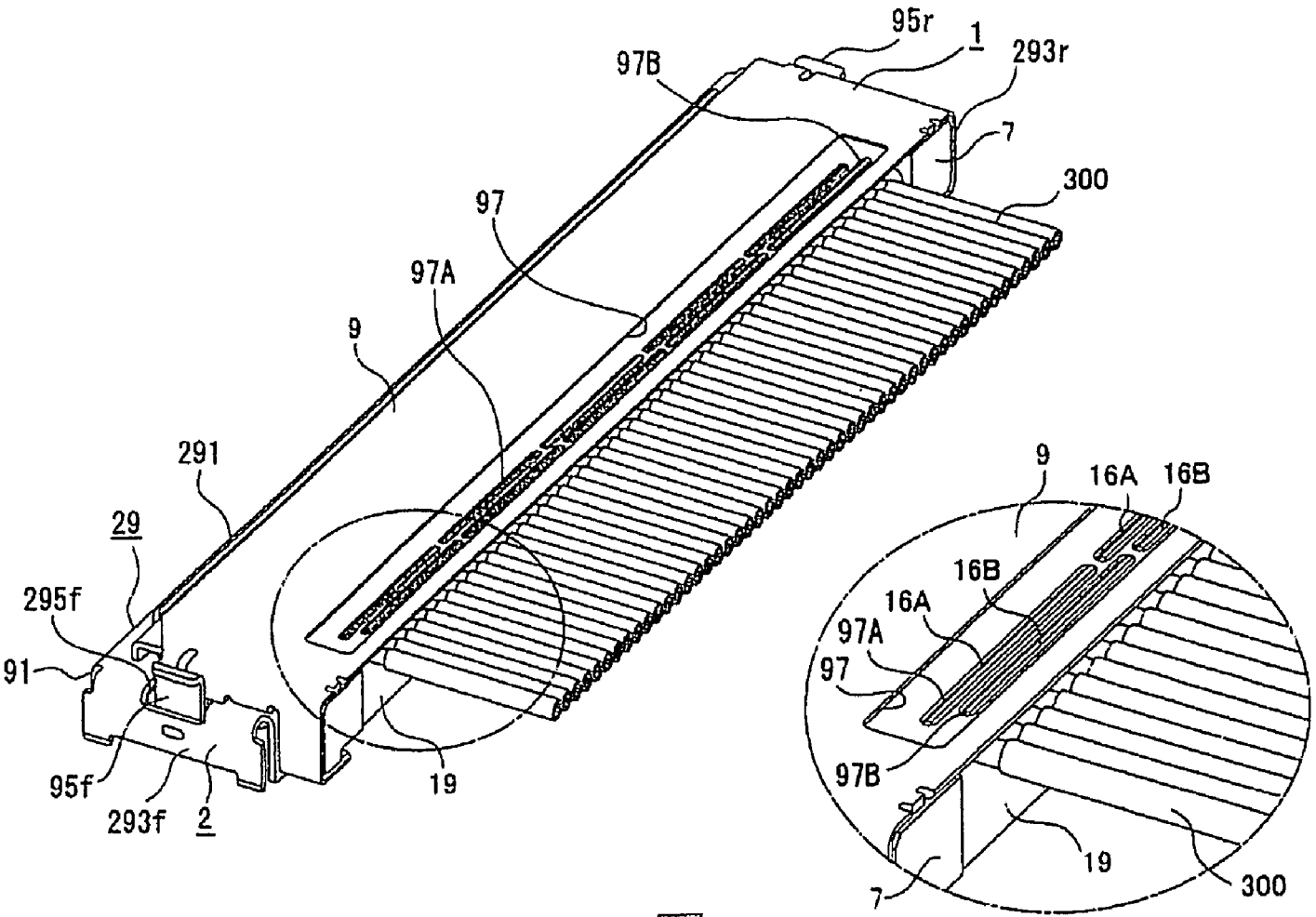
FIG. 2 is a perspective view showing the connector of the present invention as mounted to the mating connector, and an enlarged view of the essential portion thereof.
Figure 3:
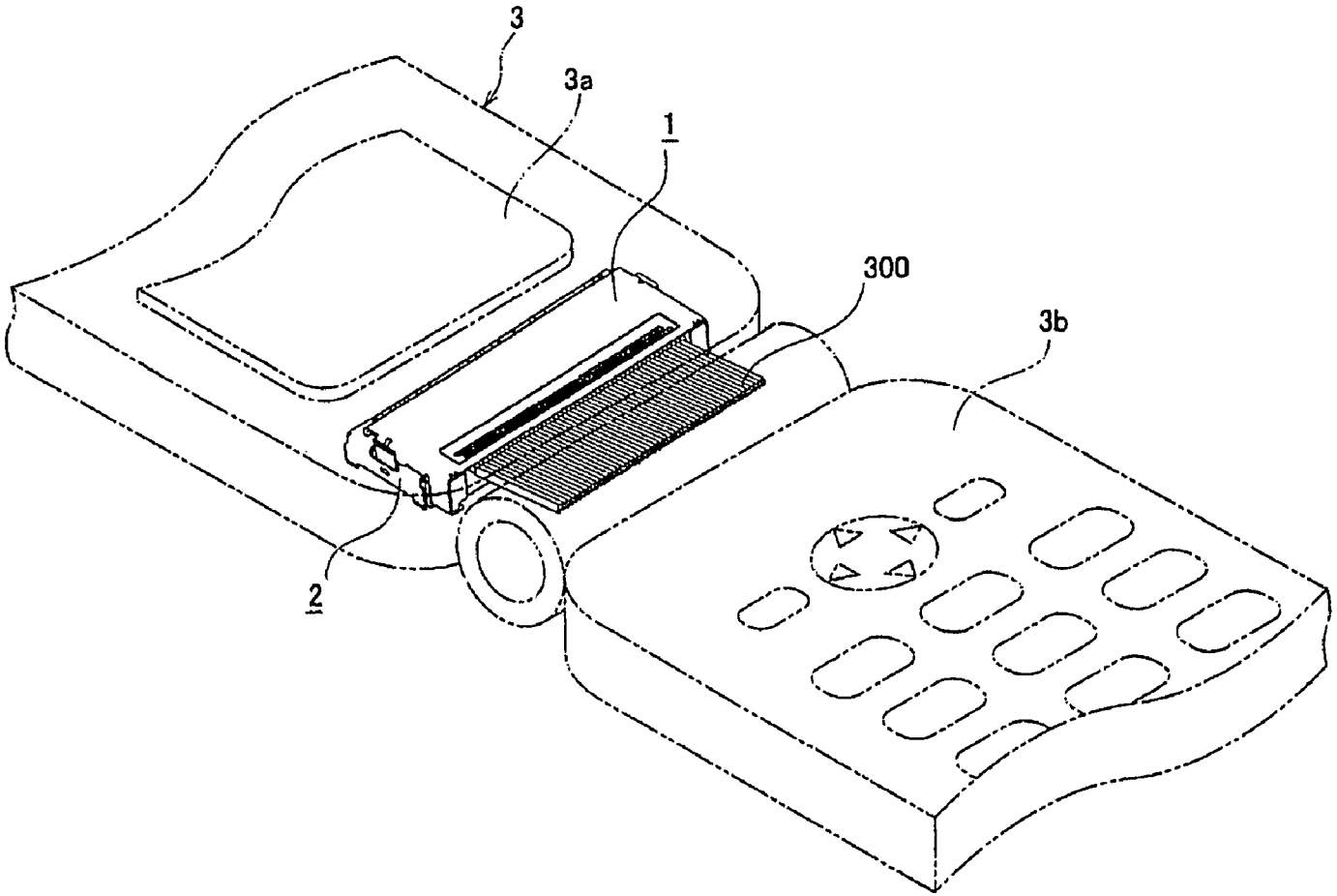
FIG. 3 is a perspective view showing the connector according to the present invention as applied to a foldable portable telephone.

FIG. 1 is a perspective view illustrating, together with a mating connector 2, a connector 1 according to the present invention in a state prior to its mounting to the mating connector 2. The illustrated connector is a plug connector. Further, FIG. 2 is a perspective view of the connector 1 as mated with the mating connector 2. It is to be noted that, although not shown in FIG. 2, the connector 1 is also attached to the other end portion of a coaxial cable 300 for mounting to the mating connector 2. FIG. 3 illustrates an example where the connectors 1, 2 are applied to a foldable portable telephone 3 indicated by imaginary lines.

Connector 1 receives one end of the coaxial cable 300 and is connected to the mating connector 2 provided in a substrate (not shown) on a liquid crystal screen side 3*a* of the illustrated portable telephone 3, and another connector 1 (not shown) is provided at the other end of the coaxial cable 300 and is connected to another mating connector 2 provided in a substrate on an operation button side 3*b* of the portable telephone 3. Accordingly, signals are transmitted between the liquid crystal screen side 3*a* and the operation button side 3*b* of the portable telephone 3, through the coaxial cable 300 having the connector 1 and the mating connector 2 provided at its opposite ends, from the operation button side 3*b* toward the liquid crystal screen side 3*a*.

As can been seen from FIG. 1 and FIGS. 4 through 7, the illustrated connector 1 has a housing 7 serving as the base of the connector 1. A shell 9 is fitted on the housing 7 to cover terminals and other parts contained in the housing 7.

Figure 4:
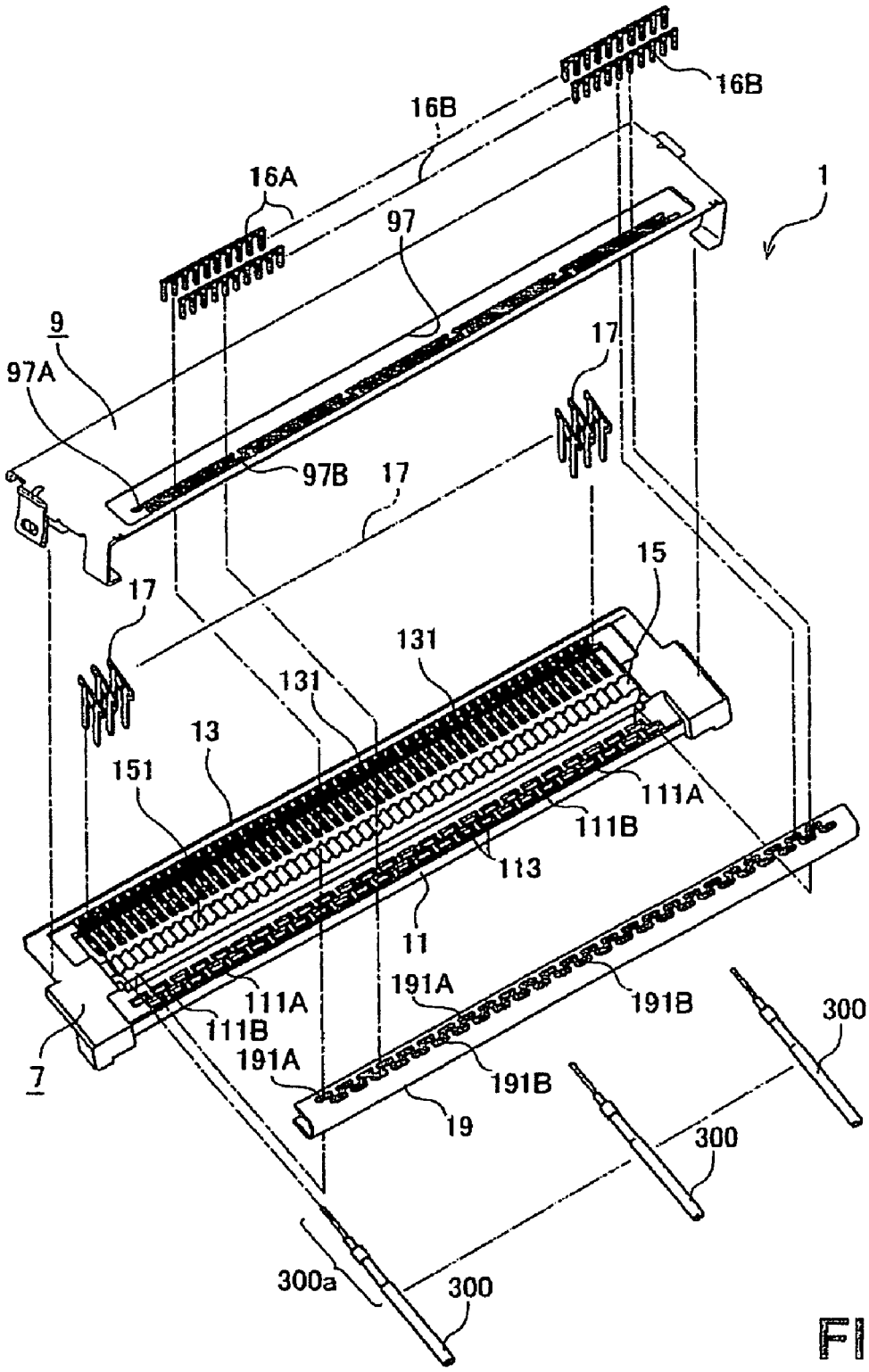
FIG. 4 is an exploded perspective view of the connector according to the present invention.
Figure 5:
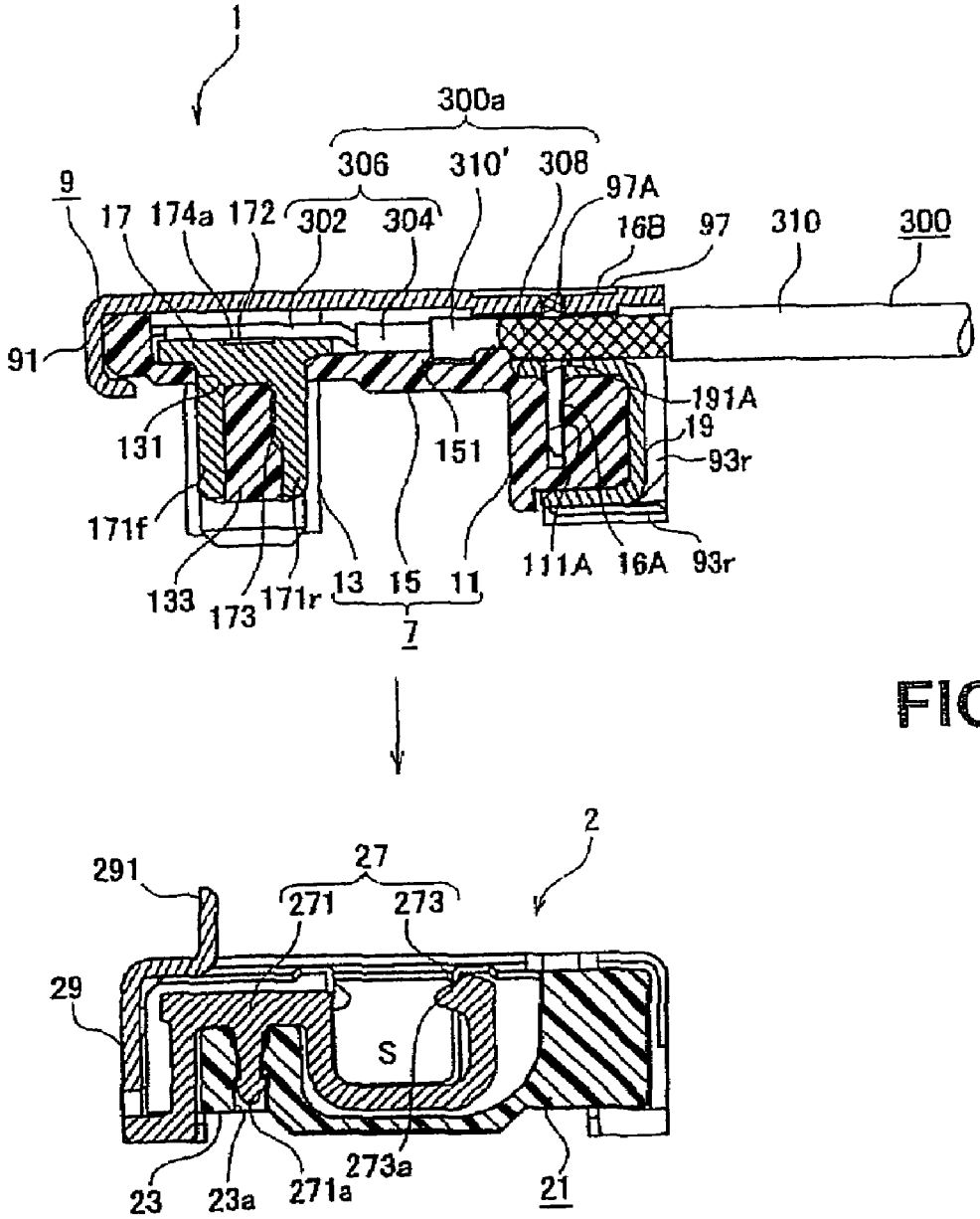
FIG. 5 is a cross-sectional view through FIG. 1.
Figure 6:
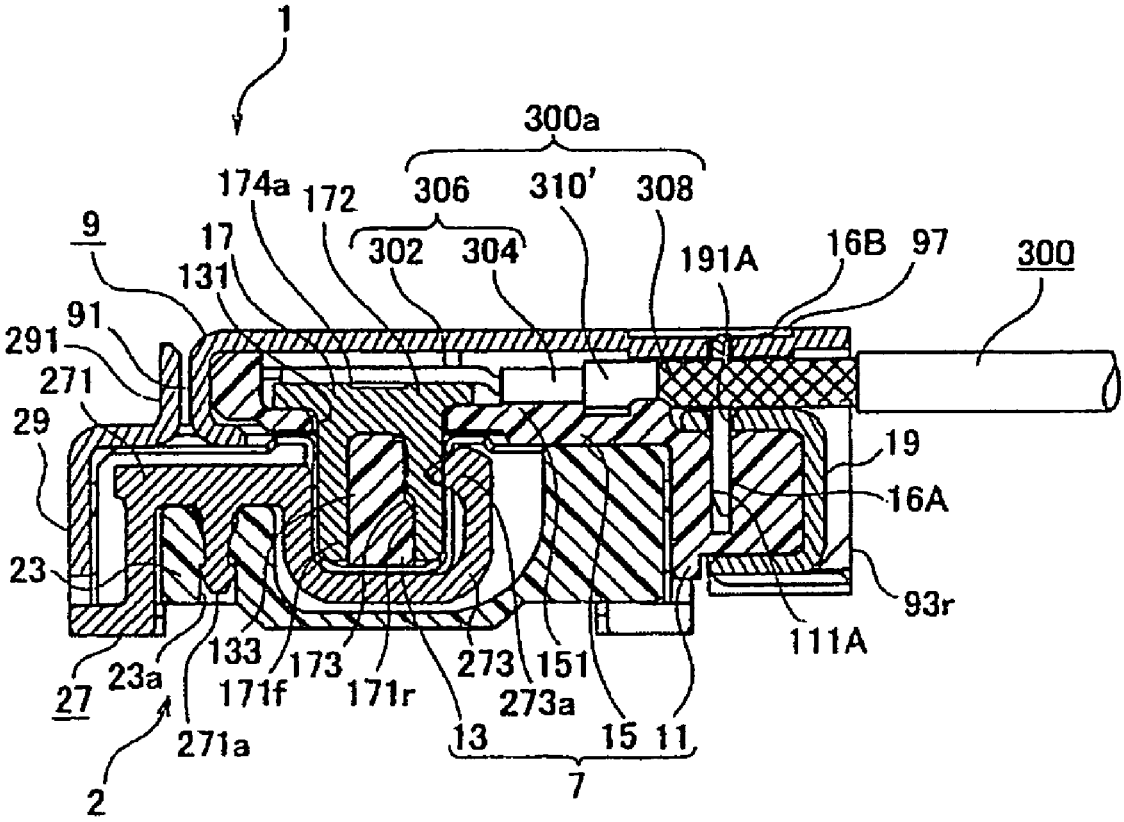
FIG. 6 is a cross-sectional view through FIG. 2.
Figure 7:
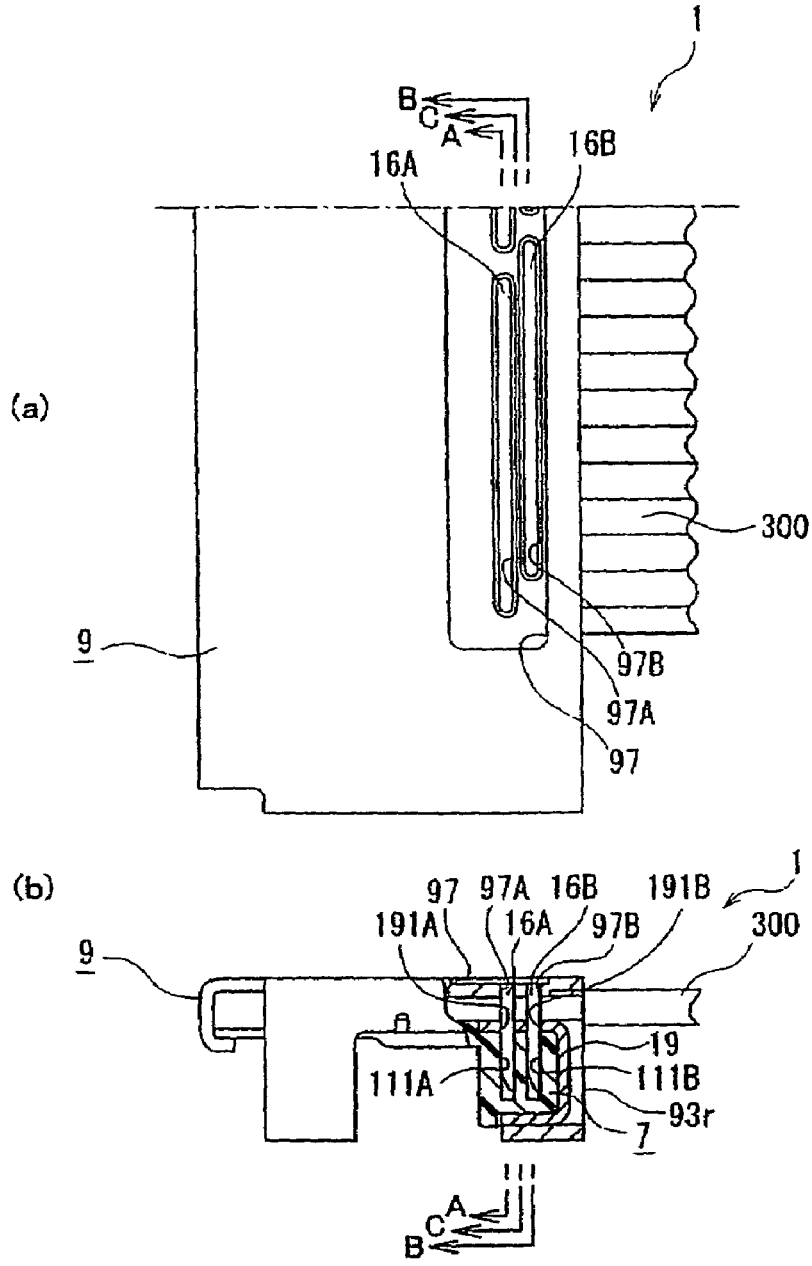
FIG. 7 is a partially cut away side view and a partially cut away plan view of the connector according to the present invention, such being collectively shown, in which part (a) is the partially cut away plan view, and part (b) is the partially cut away side view.

Further, a large number of coaxial cables 300 described above are attached between the shell 9 and the housing 7 while arranged in parallel into a flat configuration and having their respective distal end portions 300*a* (FIGS. 5 & 6) sandwiched therebetween (FIGS. 4-6).

The housing 7 is made of a synthetic resin or other insulating resin. As can be seen in FIG. 4, the housing 7 has the shape of an elongated quadrangle in a plan view and disposed in a direction orthogonal to the extending direction of the coaxial cables 300. Further, the housing 7 has a cable holding portion 11 for holding the distal end portion 300*a* of the coaxial cables 300 (hereinafter referred to as the "cable distal end portion 300*a*"), a terminal insertion portion 13 which constitutes the connecting portion with the mating connector 2 and to which the same number of terminals 17 as that of the coaxial cables 300 are inserted, and an intermediate portion 15 located intermediate the cable holding portion 11 and the terminal insertion portion 13. Due to the three portions described above, with the connector 1 attached to the mating connector 2, the housing 7 has, as seen in cross-section, a substantially rectangular shape having a downwardly-opening depression at its central portion. (FIG. 5.)

Note that, as used herein, the words "upper (top)" and "lower (bottom)" refer to the upper (top) side and the lower (bottom) side as viewed facing the drawings, and the words "front" and "rear" refer respectively, to the side on which the terminal insertion portion 13 is provided as the front and the side on which the cable holder portion 11 is provided as the rear, in the extending direction of the coaxial cable 300 as attached to the connector 1. Further, the words "left" and "right" as used herein refer to the left and right sides as viewed facing the extending direction of the coaxial cable 300. Note that the left-to-right direction is herein referred to as the width direction.

The cable holding portion 11 has a plurality of pairs of cable holders 16A, 16B each made of conductive metal and holding an outer conductor 308 of each of the plurality of coaxial cables 300 while traversing the same (FIGS. 4-10), and one ground bar 19 made of conductive metal like the cable holders 16A, 16B. By this arrangement, the conductor 308 is brought into electrical connection with the ground bar 19 and the plurality of pairs of cable holders 16A, 16B.

Figure 11:
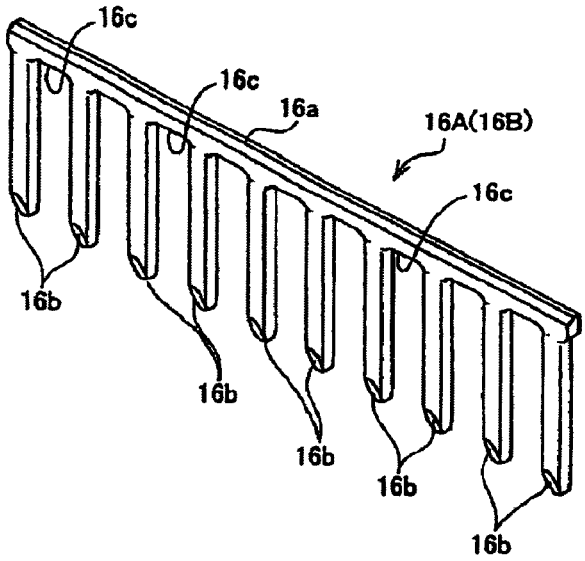
FIG. 11 is a perspective view of a cable holder.
Figure 12:
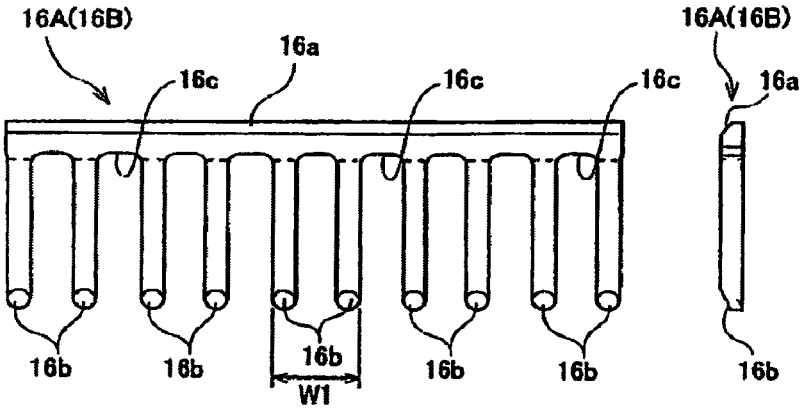
FIG. 12 is a front view and a side view of the cable holder, such being collectively shown, in which part (a) is the front view and part (b) is the side view.
Figure 33:
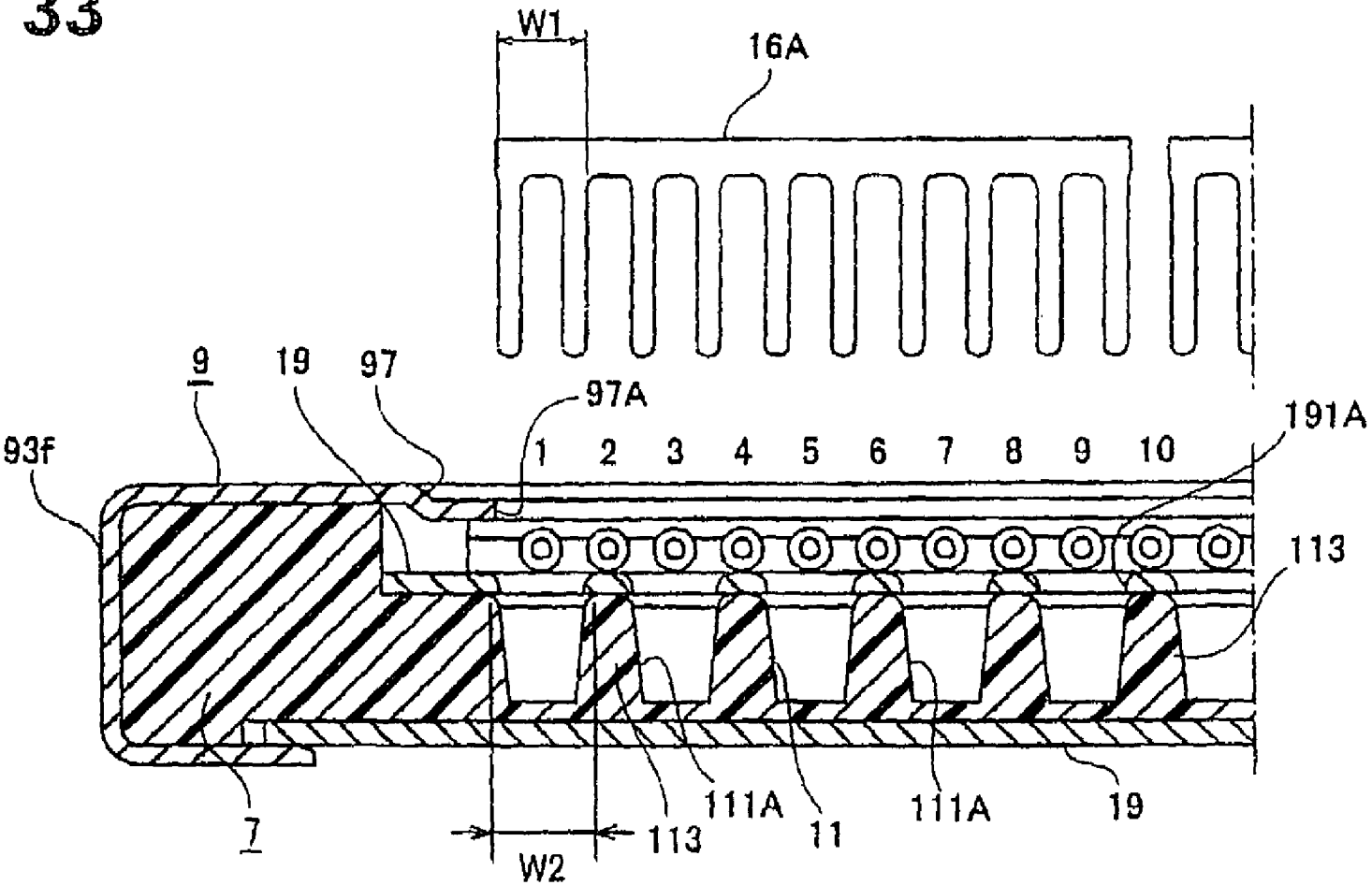
FIG. 33 is an enlarged vertical sectional view showing a state immediately prior to mounting to the housing of the cable holder for holding the odd-numbered coaxial cable as counted from the left side of the drawing.
Figure 34:
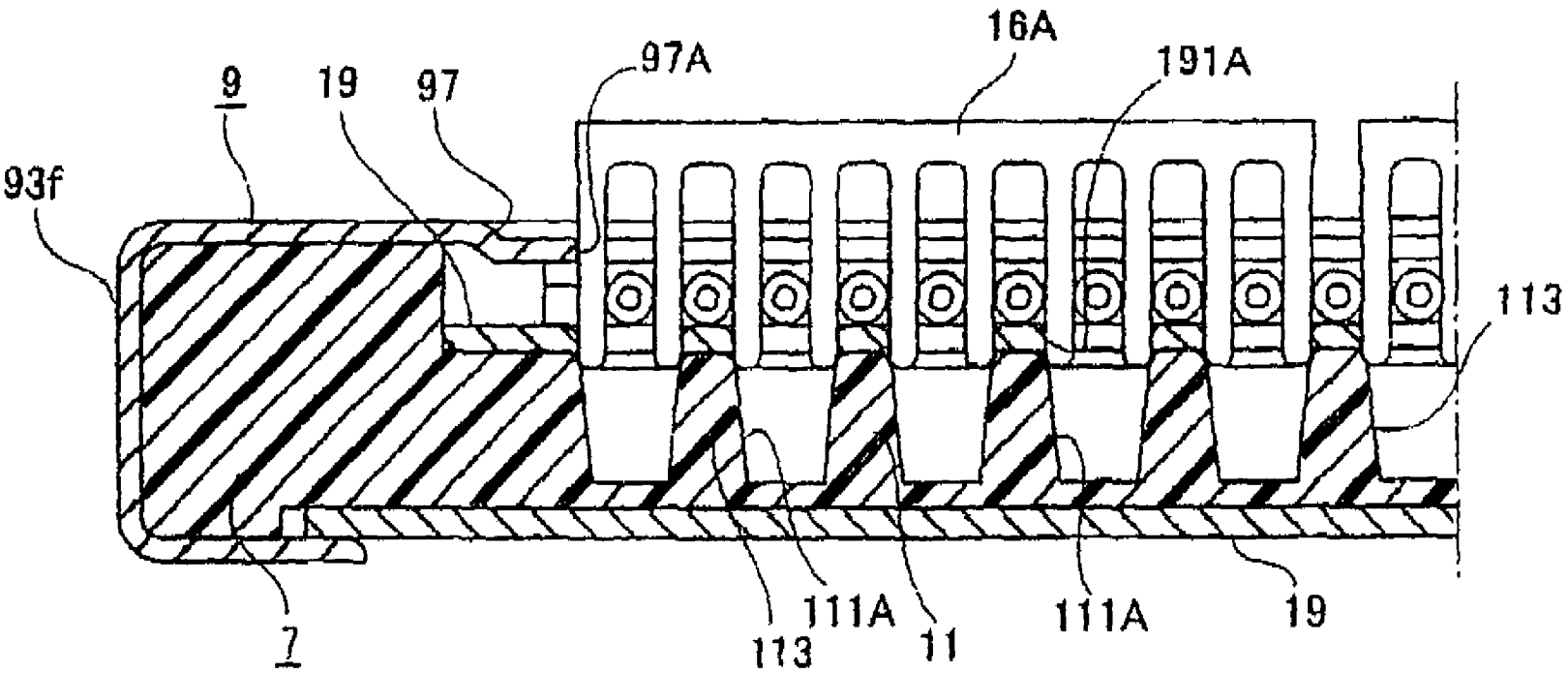
FIG. 34 is a diagram continuous from FIG. 33, showing a state immediately after mounting the cable holder to the housing.

The cable holders 16A and 16B are identical in configuration and differ only in their mounting positions in the cable holding portion 11. Accordingly, only one of the cable holders, namely the cable holder 16A, is described below. As shown in FIGS. 11 & 12, the cable holder 16A has a substrate portion or backbone 16*a* extending in the left-to-right direction, and a large number of cantilever-like legs or tines 16*b* that are fixed at one end and free at the other end and extend downwardly in parallel from the substrate portion or backbone 16*a*. The legs or tines are arranged in pairs of two each, forming downwardly-opening and reverse-U-shaped multiple grooves 16*c* of the same number as that of the coaxial cables 300. A width W1 (FIGS. 12 & 33) between adjacent legs or tines 16*b* forming each groove 16*c* is set to be substantially the same as a width W2 (FIG. 33) of each of cable holder fitting holes 111A and 111B which are provided in the housing 7 and in which the cable holders 16A, 16B are fitted.

The difference between the cable holders 16A and 16B is that the cable holder 16A serves to hold the odd-numbered coaxial cables 300A, and the cable holder 16B serves to hold the even-numbered coaxial cables 300B, as counted according to the plurality of coaxial cables 300 arranged in parallel from the end (the left side in FIG. 4) of the coaxial cables 300 (FIGS. 4 & 8-10). Further, the cable holders 16A and 16B are respectively associated with a large number of the cable holder fitting holes 111 A and 111B provided in the cable holding portion 11 (see FIGS. 4, 8, 9). Of the cable holders 16A and 16B, respective sets of a pair of adjacent legs or tines 16*b*, 16*b* are inserted into the cable holder fitting holes 111A and 111B.

These sets of the pairs of legs or tines 16*b*, 16*b* are simultaneously inserted into the multiple cable holder fitting holes 111A and 111B. Note that each set of the pair of legs or tines 16*b*, 16*b* is referred to as the double-legged or double-tined portion. The total number of each of the cable holder fitting holes 111A and 111B is the same as that of the coaxial cables 300. As seen in vertical section with respect to the front-to-rear direction, the cable holder fitting holes 111A and 111B are each shaped like an inverted truncated isosceles triangle and tapered such that its opening is large at the top and small at the bottom. (FIGS. 8, 9, 33 & 34.) A partition wall 113 is provided between adjacent cable holder fitting holes 111A and between adjacent cable holder fitting holes 111B. (FIG. 4.)

Figure 8:
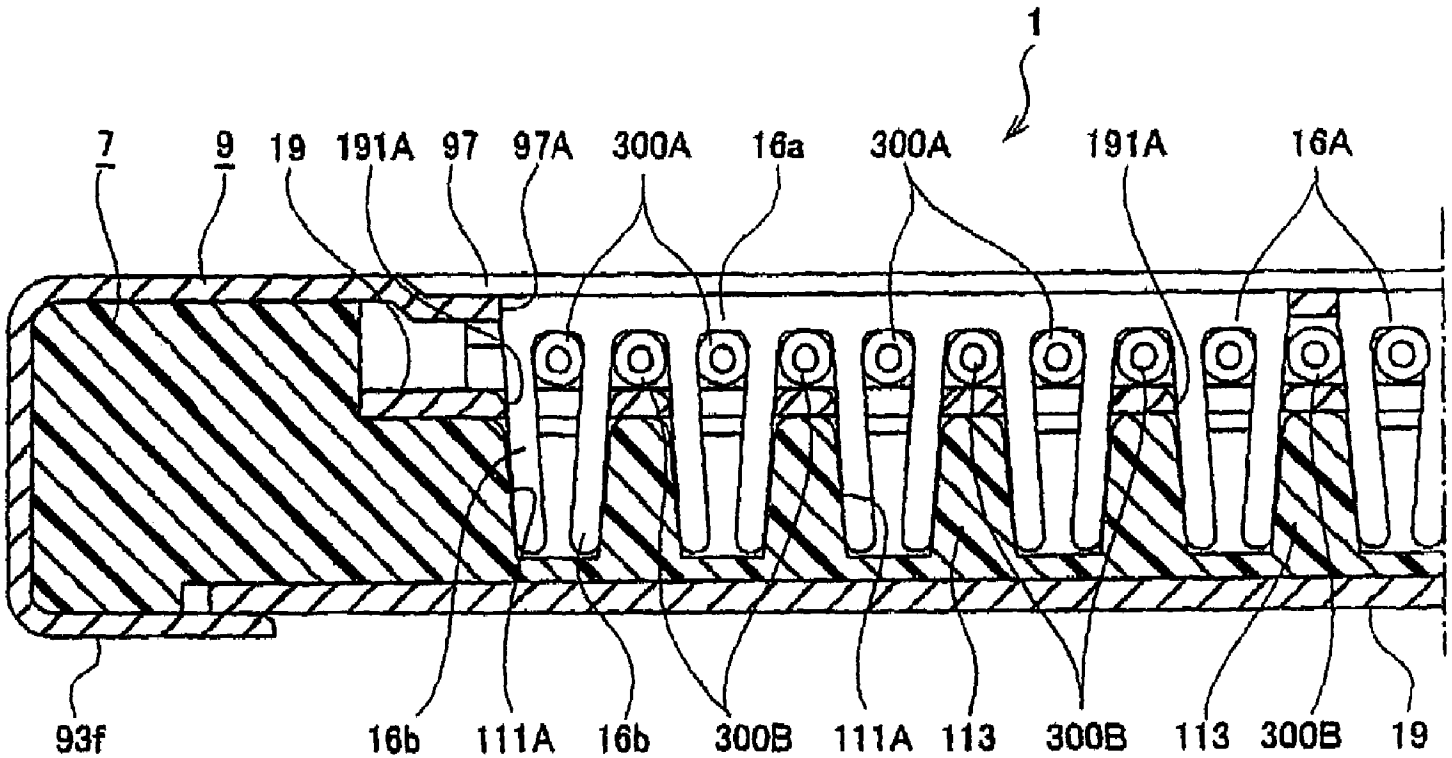
FIG. 8 is an enlarged sectional view taken along the line A-A of FIG. 7.
Figure 9:
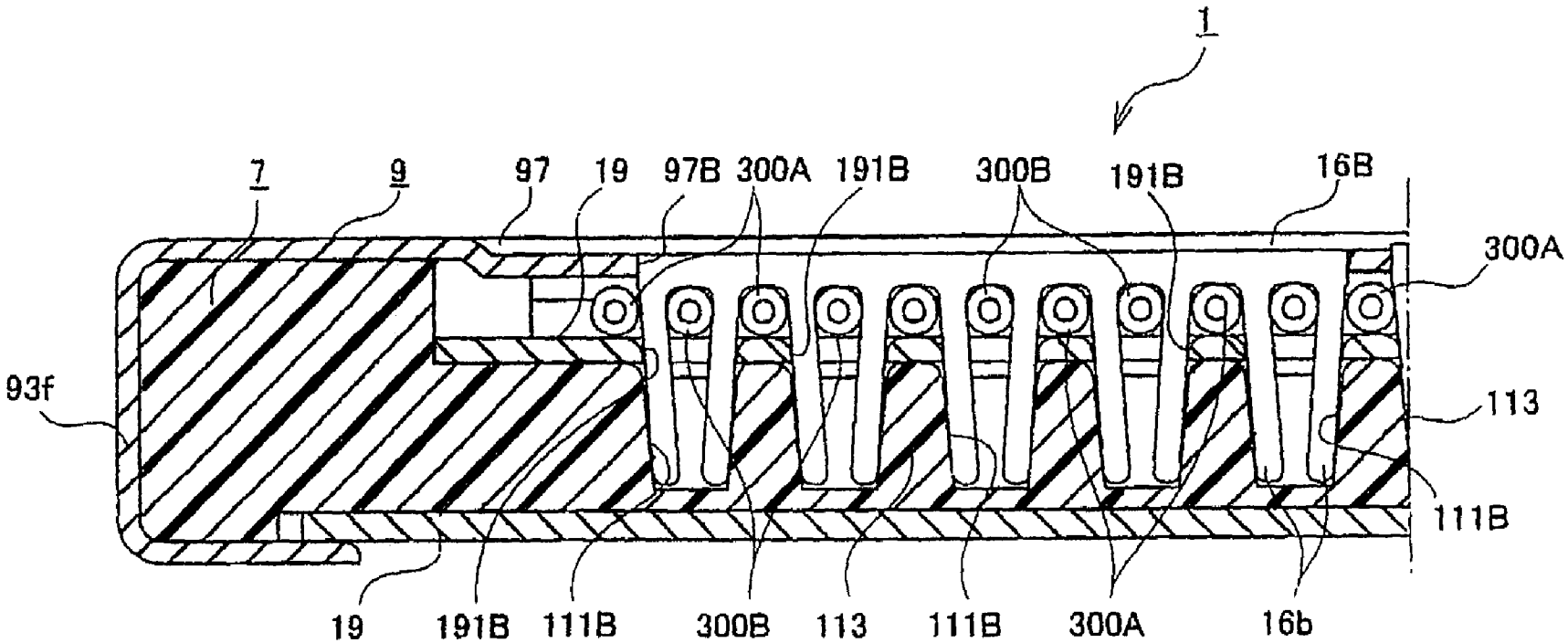
FIG. 9 is an enlarged sectional view taken along the line B-B of FIG. 7.

The cable holders 16A and 16B are engaged with the cable holder fitting holes 111A, 111B, respectively, in order to hold the coaxial cables 300 in a state of being in contact with the outer conductor 308 of each coaxial cable 300, by the double-legged or double-tined portion and the substrate portion or backbone 16*a* in order to straddle and nip or pinch the coaxial cables 300 (see FIGS. 5 and 6), thereby securely holding them in place. The cable holders 16A, 16B are arranged such that they are parallel to each other in the front-to-rear direction but are offset from each other in the left-to-right direction (FIGS. 4, 8 & 9). To realize this arrangement, a large number of cable holder fitting holes 111A and 111B, into which the cable holders 16A, 16B are respectively inserted, are formed linearly and equidistant from each other along the rear edge of the housing 7 such that they are parallel to each other in the front-to-rear direction but offset from each other in the left-to-right direction. (FIGS. 4, 8, 9, 24 & 25.)

Figure 26:
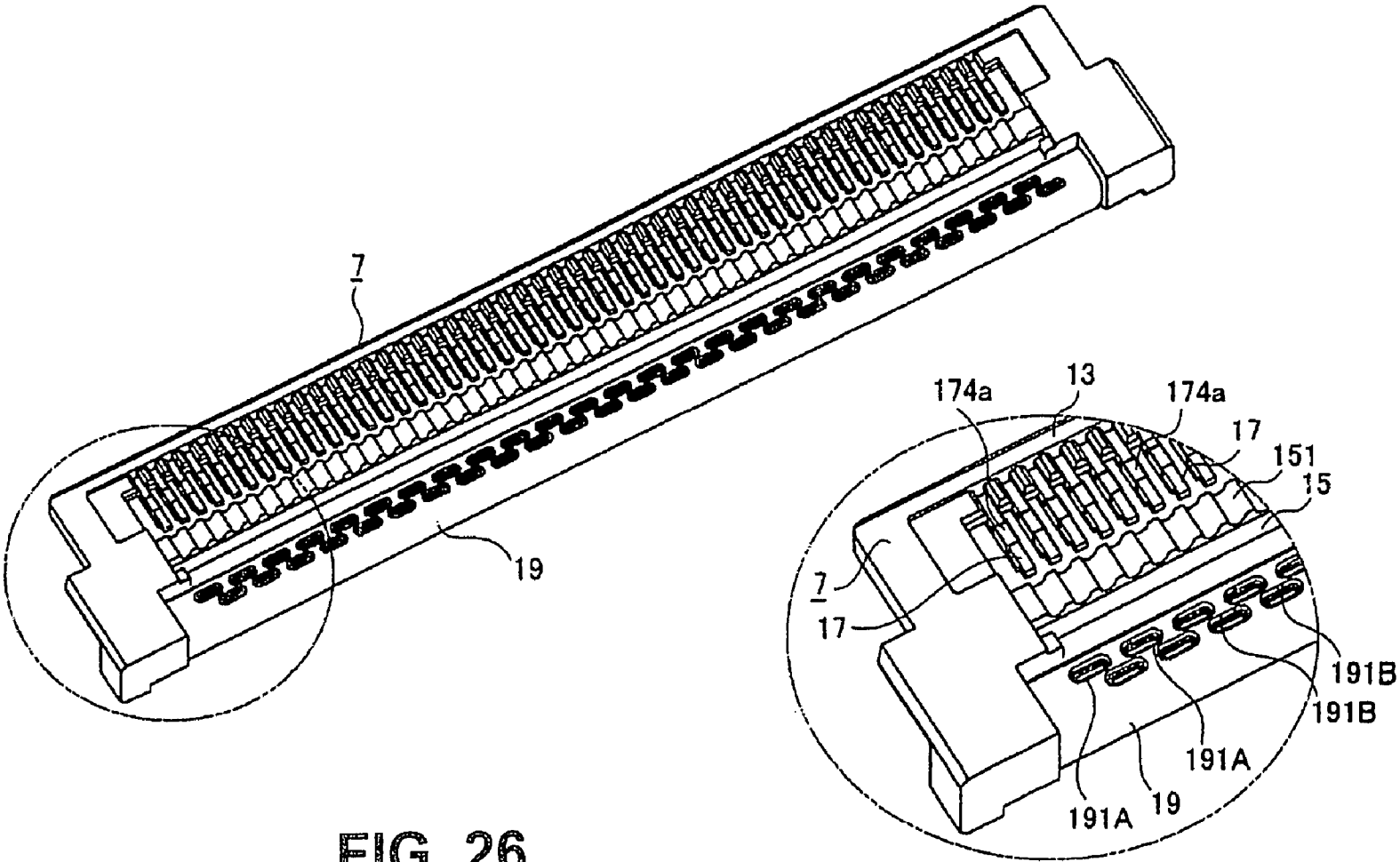
FIG. 26 is a perspective view showing a state in which a ground bar is attached to the housing of FIG. 24, and an enlarged view of the essential portion thereof.

By inserting the cable holders 16A, 16B into the cable holder fitting holes 111A, 111B, respectively, the outer conductor 308 of each coaxial cable 300 is sandwiched from above and below by, and electrically connected with the ground bar 19 and the cable holders 16A, 16B. (FIGS. 5, 6, 8, 10, 33 & 34.) The ground bar 19 is mounted so as to hold the cable holding portion 11 from the rear side of the cable holding portion 11 from three directions, that is, from above, below, and the rear (see FIG. 4). Accordingly, the ground bar 19 has a hollow square pole-like configuration that is preferably open at its front and right and left sides, such that it has the shape of a horizontally channel when seen in cross section. Further, through-holes 191A and 191B, which are opposed to the cable holder fitting holes 111A and 111B, respectively, are formed in the upper surface of the ground bar 19 in the same number as that of the cable holder fitting holes 111A and 111B. (FIGS. 4, 6 & 26.)

It will be appreciated that a large number of through holes 191A and 191B are formed linearly and at equal intervals from each other such that they are parallel in the front-to-rear direction, but offset in the left-to-right direction, from each other. Accordingly, upon mounting the ground bar 19 from the rear of the cable holding portion 11, the cable holder fitting hole 111A and the cable holder fitting hole 111B are located coaxially in the top-to-bottom direction with respect to the through hole 191A and the through-hole 191B, respectively. (FIGS. 8 & 9.)

The terminal insertion portion 13 of the housing 7 is provided with insertion holes 131 into which the terminals 17 are press fitted from above. (FIGS. 4-6.) Each insertion hole 131 is an elongated hole extending in the front-to-rear direction. Provided inside the insertion hole 131 (FIGS. 5 & 6.) is a terminal holding portion, or male mating or plug portion, 133 for holding the terminal 17 fitted thereon. The terminal, which is connected to an inner conductor 302 of the coaxial cable 300 by soldering, is formed by machining a thin metal plate. Further, as shown in FIGS. 4, 5, 6, 13, 14, 18, 19, 20 & 35, the terminal is sized and shaped to be inserted in the terminal insertion portion 13. The terminal has a body portion that has a termination surface and at least one contacting portion extending therefrom. The illustrated terminal 17 has multiple contacting portions including a front upright leg 171*f* and a rear upright leg 171*r*, which are spaced from each other in the front-to-back direction. A body or connecting portion 172 is provided on top of those legs and connects the two legs 171*f*, 171*r* at their respective one ends, thus defining a substantially gate-like double-legged configuration in this illustrated embodiment.

Figure 13:
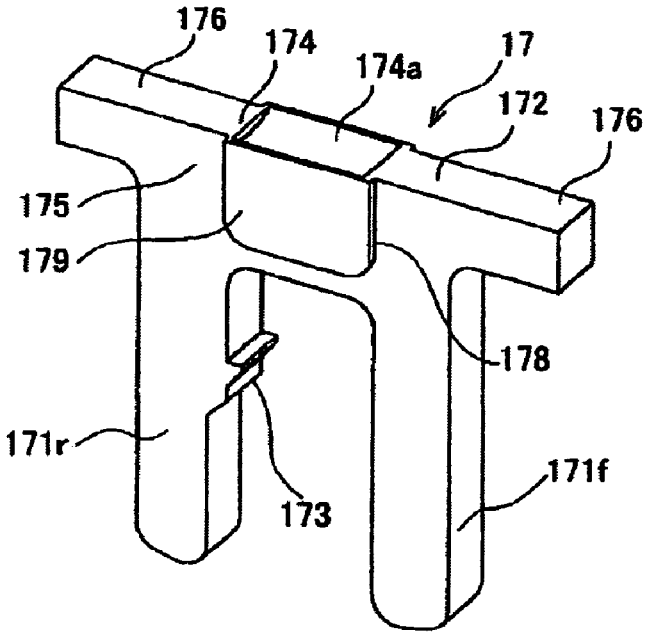
FIG. 13 is a perspective view of a terminal as seen from one direction.
Figure 14:
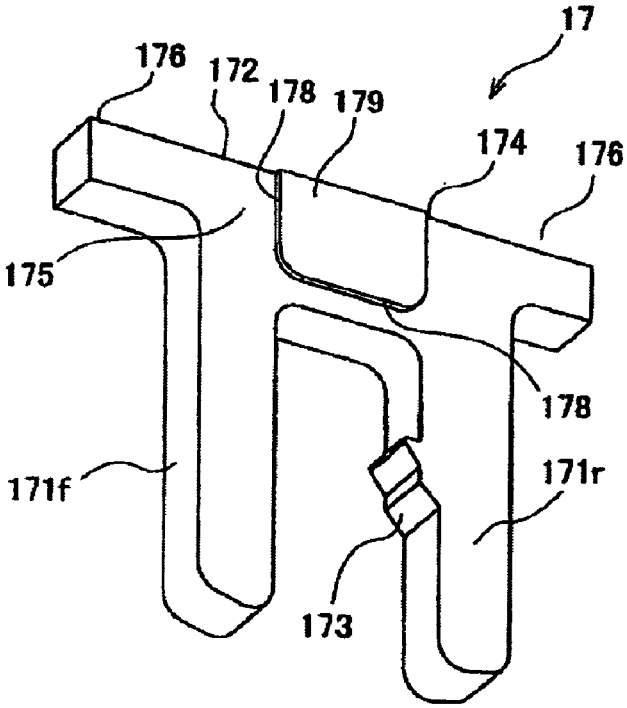
FIG. 14 is a perspective view of the terminal as seen from another direction from that of FIG. 13.
Figure 15:
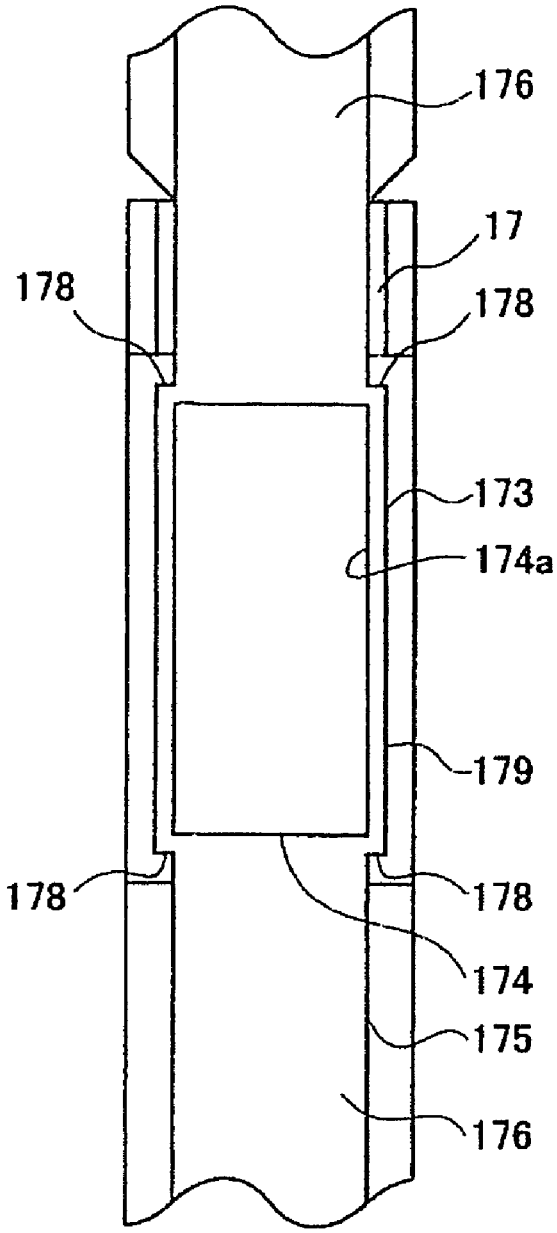
FIG. 15 is an enlarged plan view of a selected portion including a portion of a housing which includes the terminal.
Figure 16:
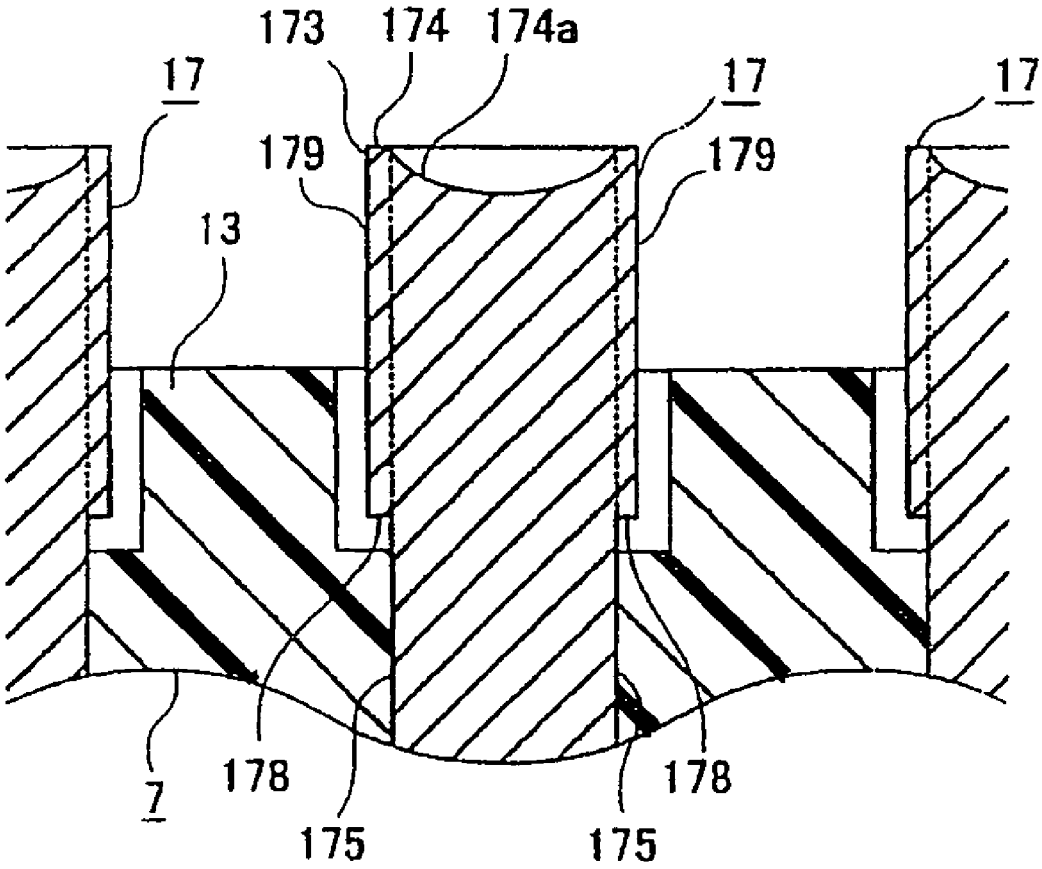
FIG. 16 is a cross-sectional view of a selected portion of FIG. 15.
Figure 17:
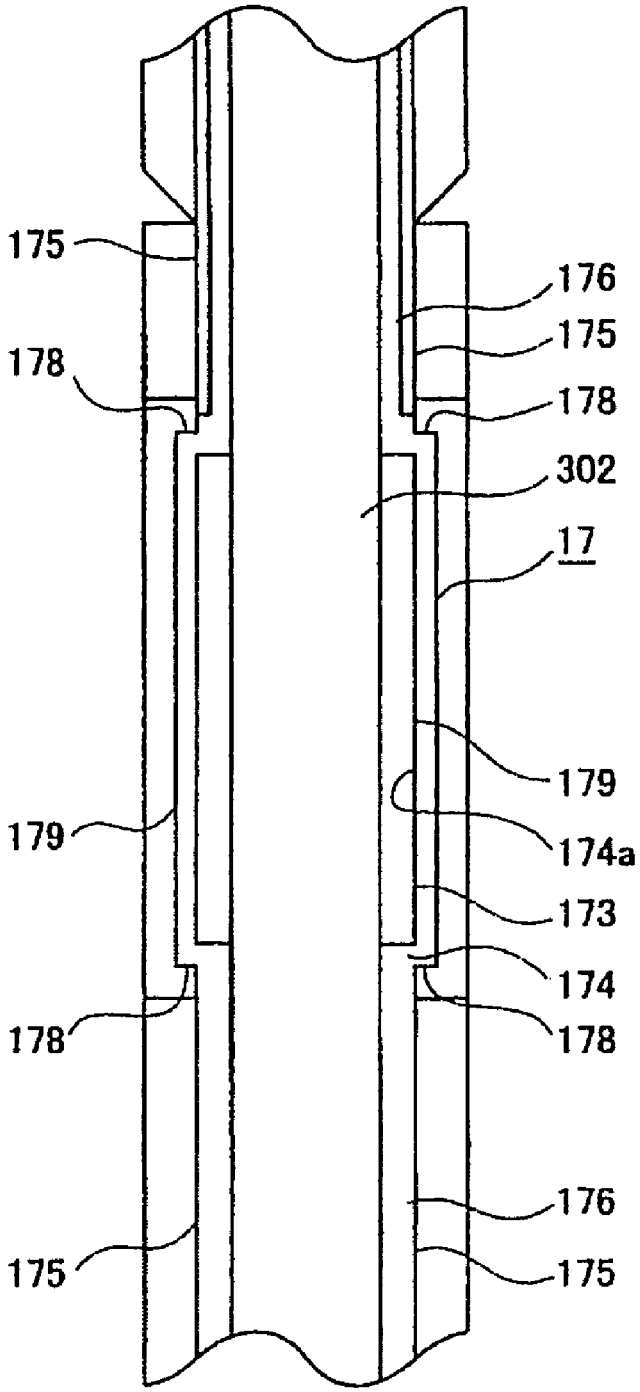
FIG. 17 is an enlarged plan view of a selected portion illustrating the case where an inner conductor of a coaxial cable is placed in the terminal of FIG. 14.
Figure 18:
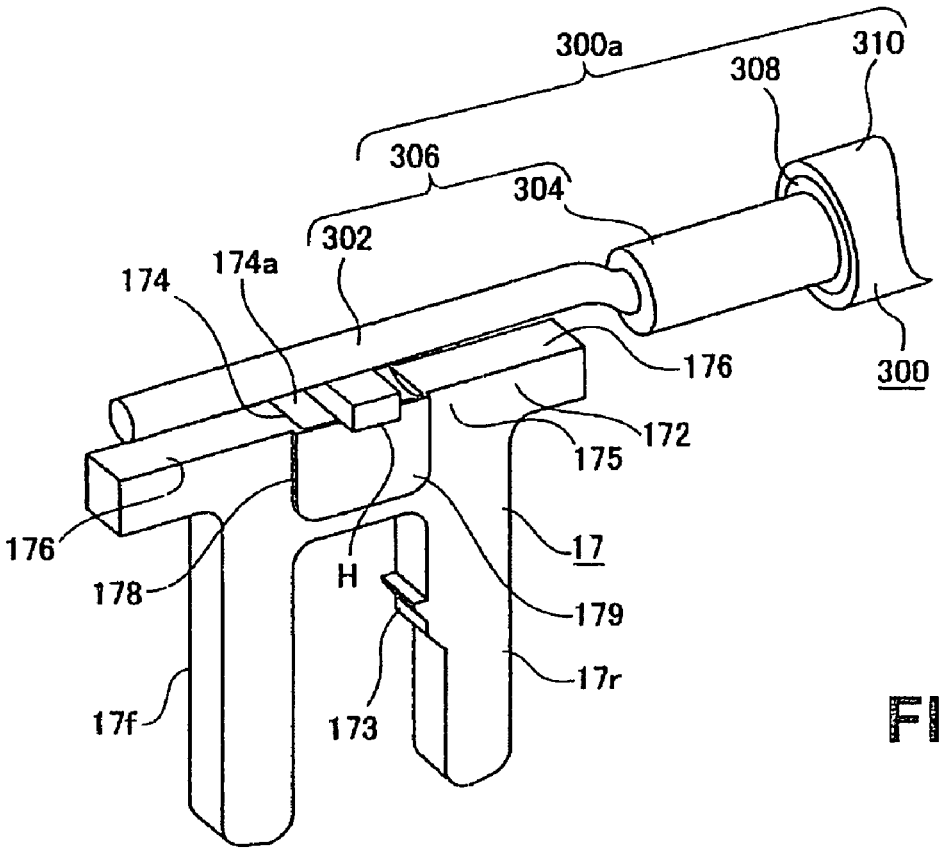
FIG. 18 is a perspective view showing a first step of an illustrated soldering procedure for soldering the terminal and the coaxial cable together.

Formed on the inner side of the rear upright leg 171*r* is a locking member 173 for preventing dislodging of the terminal 17 inserted in the insertion hole 131 (see FIGS. 13 and 14). The terminal 17 is received into the insertion hole 131 of the terminal insertion portion 13 from the distal end of the terminal 17, the distal end being the free end side of the respective upright legs 171*f*, 171*r*. When the terminal 17 is inserted into the insertion hole 131, the locking member 173 bites into the male mating, plug or terminal holding portion 133 (see FIGS. 5 and 6), thereby preventing dislodging of the terminal 17.

As shown in FIGS. 13-23, the connecting portion 172 includes a soldering region 174 that is an area to be soldered onto the inner conductor 302 of the coaxial cable 300. Formed in the soldering region 174 is a recess or an elongated depression 174*a* taking the form of a pocket or well extending in the longitudinal direction of the connecting portion 172 and adapted to receive a fillet. As seen in cross section, the depression 174*a* has an arcuate bottom surface (see FIGS. 13 and 21). The depression 174*a* is formed by stamping. The soldering region 174 is formed in one surface of the connecting portion 172 on the side opposite to inserting direction of the terminal 17 (the upper surface in FIG. 13). Further, the soldering region 174 has a wide lateral width as compared with the other region of the connecting portion 172 of the terminal 17, namely a termination surface or flat surface region 176 where the soldering region 174 is not formed. (FIGS. 13-18.) By thus forming the soldering region 174 that is laterally wide, a path, track or step 178 is formed at the boundary portion with another termination surface or flat surface region 176. (FIGS. 13-19.)

Due to the step 178, there is formed on either side surface of the connecting portion 172 a side wall or stepped portion 179 that is an island-like region extending continuously to the soldering region 174 and protruded with respect to a side surface region 175 that is the other side surface region of either side surface (see FIGS. 13 through 20). The stepped portion 179 is formed by punching the non-stepped portion.

As shown in FIGS. 4-6, the intermediate portion 15 of the housing 7 has an inner insulator installation portion 151 where an inner insulator 304 of the coaxial cable 300 is installed. The same number of the inner insulator installation portions 151 as that of the coaxial cables 300 are formed in a continuous manner in the left-to-right direction. Further, the inner insulator installation portion 151 has a substantially horizontal S-shaped sectional configuration so as to provide a good seating for the inner insulator 304 when it is installed in the inner insulator installation portion 151. Regarding the sectional configuration, the curvature of the portion where the inner insulator 304 is installed is set to be the same as the curvature of the inner insulator 304. (FIGS. 4 & 24-27).

Figure 10:
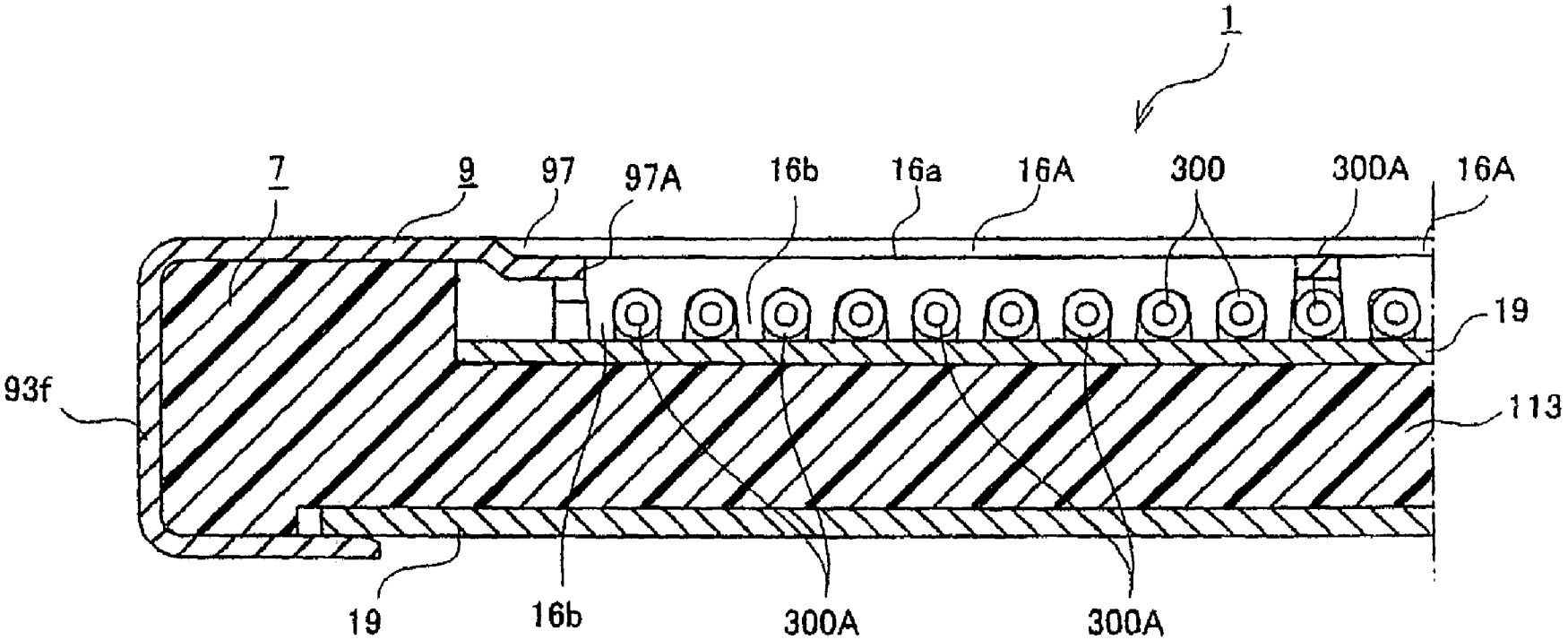
FIG. 10 is an enlarged sectional view taken along the line C-C of FIG. 7.

The shell 9 of the connector 1 is made of conductive metal. Further, since the shell 9 serves to cover the housing 7, like the housing, the shell 9 is shaped as an elongated quadrangle in plan view. (FIG. 4.) Further, the front edge of the shell 9 is formed as a folded portion 91 bent into a fold toward the rear side. (FIG. 5.) The rear portions of the opposite side edges of the shell 9 extend downwardly, forming side arms 93*f*, 93*r* having their respective distal ends folded inwardly so as to embrace the cable holding portion 11 of the housing 7 from both sides (see FIGS. 1 and 4). At this time, both the side arms 93*f*, 93*r* are in abutment with the bottom portion of the ground bar 19 for electrical connection therewith. (FIGS. 5, 8 & 10.) Further, formed in the opposite side edges at a position closer to the front edge are locking members 95*f*, 95*r* for mounting the connector 1 to the mating connector 2. (FIGS. 1 & 2.)

The locking members 95*f*, 95*r* each has a substantially U-shaped vertical section with its downwardly extending tongue member folded back upwardly at the central portion thereof. The locking members 95*f*, 95*r* exhibit a resilient force when applied with an external force acting to close the opening of the U-shape. Further, the distal ends of the locking members 95*f*, 95*r* are bent slightly sideways.

Formed substantially over the rear half portion of the ceiling surface of the shell 9 is a shallow flat recess 97 extending in the left-to-right direction along the rear edge of the ceiling surface. As shown in FIG. 4, the through holes 97A, 97B, into which the cable holders 16A, 16B are respectively inserted, are formed in the flat recess 97 in the same number as the number of the cable holders 16A, 16B (which is ten in the drawing). While, like the through holes 191A, 191B and the cable holder fitting holes 111A, 111B, the through holes 97A, 97B are also formed parallel to each other in the front-to-back direction but offset from each other in the left-to-right direction (FIGS. 4 & 8-9), the through holes 97A, 97B are larger than those holes. When fitting the shell 9 over the housing 7, the through holes 97A, 97B of the shell 9 are opposed to the through holes 191A, 191B of the ground bar 19 and the cable holder fitting holes 111A, 111B of the housing 7, respectively (FIGS. 5 & 6).

The length of the respective legs or tines 16*b* of the cable holders 16A and 16B, the depth dimension of the cable holder fitting holes 111A, 111B of the housing 7, and other various dimensions are selected such that when, as described above, the cable holders 16A and 16B are fit-engaged with the cable holder fitting holes 111A, 111B (FIGS. 5 & 6), the substrate portions 16*a* of the cable holders 16A and 16B are exposed and located within the through holes 97A/97B (FIGS. 5, 6 & 8-9). Further, the substrate portion 16*a* is formed slightly larger than the through holes 97A, 97B with respect to the width direction. Accordingly, when the cable holders 16A and 16B are fully fit-engaged with the housing 7, the substrate portion 16*a* comes into an interference-fit with the through-holes 97A/97B, thereby preventing dislodging and providing secure electrical connection between the shell 9 and the cable holders 16A, 16B.

Typical mounting steps (1) through (6) for the connector 1 described above now are summarized with reference to FIGS. 24-32 and their associated drawings. It is to be noted from FIG. 5 that the illustrated coaxial cable 300 has a distal end portion 300*a* comprising a signal line 306 having a conductor 302 that is at an inner location within the cable. This inner conductor is exposed and not covered by the inner insulator 304, or by another inner or intermediate sheath (or a sheath-remaining portion 310'). Also not covering these components is an outer shield or outside conductor 308 and an outside insulator 310. In the illustrated arrangement, the distal edge of the sheath 310' is situated immediately to the right or rear of the signal line 306, the distal edge of the outside conductor 308 is situated close to the right or rear of the sheath 310', and the distal edge of the outer insulator close to the right or rear of the outside conductor 308. In this construction, the outer insulator 310 remains when shown, and the outside conductor 308 is exposed where only the outer insulator 310 is not present, such as by having been stripped off. (FIGS. 5 & 6.)

In proceeding with step (1), each terminal 17 is inserted into the insertion hole 131 of the housing 7, thereby attaching each terminal 17 to the housing 7. This is illustrated in FIGS. 4, 5 & 24-25. A next step, or step (2), attaches the ground bar 19 to the cable holding portion 11. This is illustrated in FIGS. 4, 5 & 25-26.

By step (3), the terminal 17 and the inner conductor 302 of the coaxial cable 300 are soldered together (FIGS. 18-23 & 27). In FIGS. 18-23, H denotes solder (linear solder). Further, reference symbol Hi denotes solder fusing device (pulse heat or soldering iron).

The soldering procedures are as follows. As shown in FIGS. 18-21, the solder H is placed on the depression 174*a* so as to be orthogonal to the longitudinal direction of the terminal 17, and the inner conductor 302 of the coaxial cable 300 is placed on the solder H so as to be in parallel to the terminal 17. This illustrates the soldering procedure of step (1).

Figure 19:
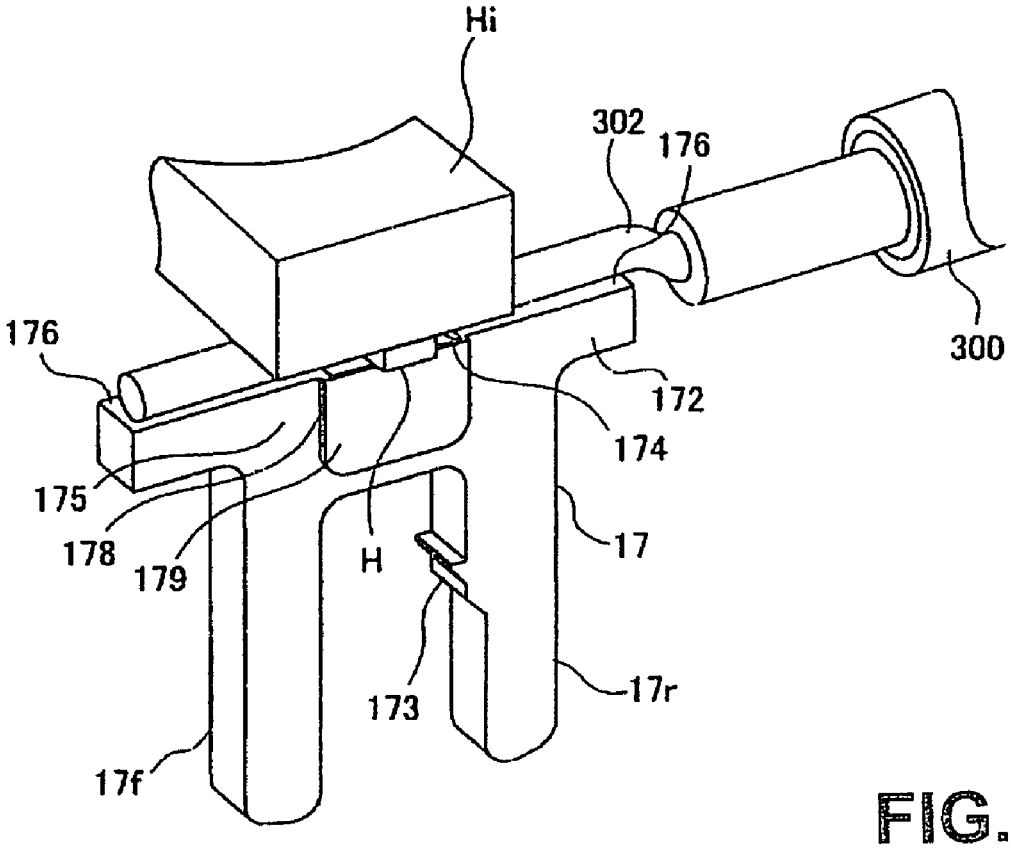
FIG. 19 is a perspective view showing a second step of the illustrated soldering procedure for soldering the terminal and the coaxial cable together.
Figure 20:
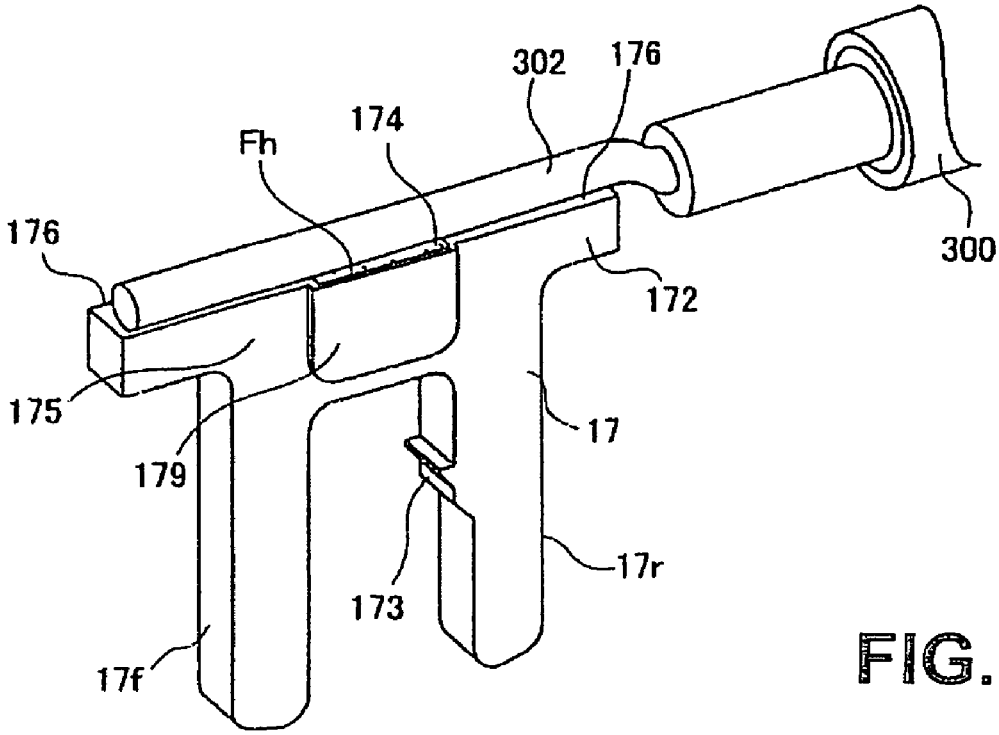
FIG. 20 is a perspective view showing a third step of the illustrated soldering procedure for soldering the terminal and the coaxial cable together.
Figure 21:
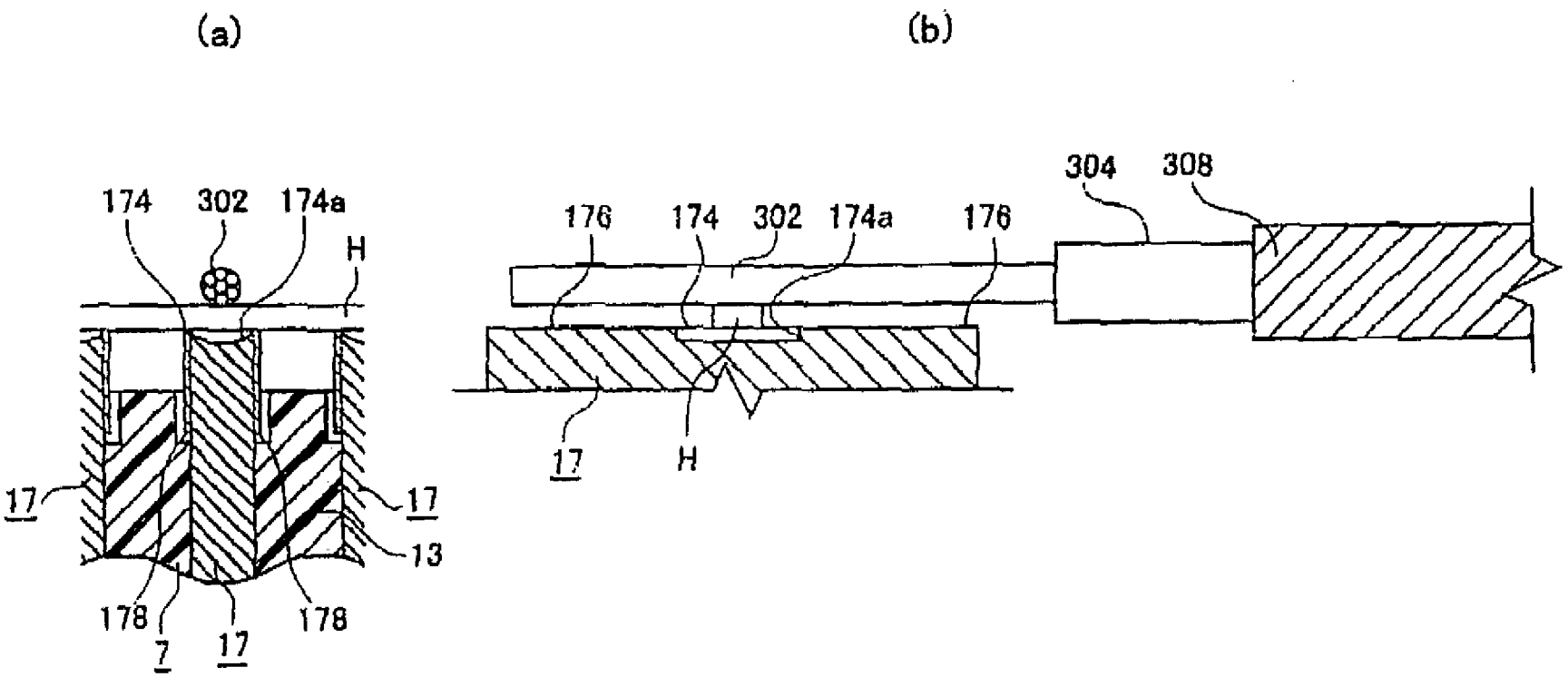
FIG. 21 is a longitudinal sectional view of a selected portion and a transverse sectional view of a selected portion FIG. 18 shown together, in which part (a) is the longitudinal sectional view and part (b) is the transverse sectional view.
Figure 22:
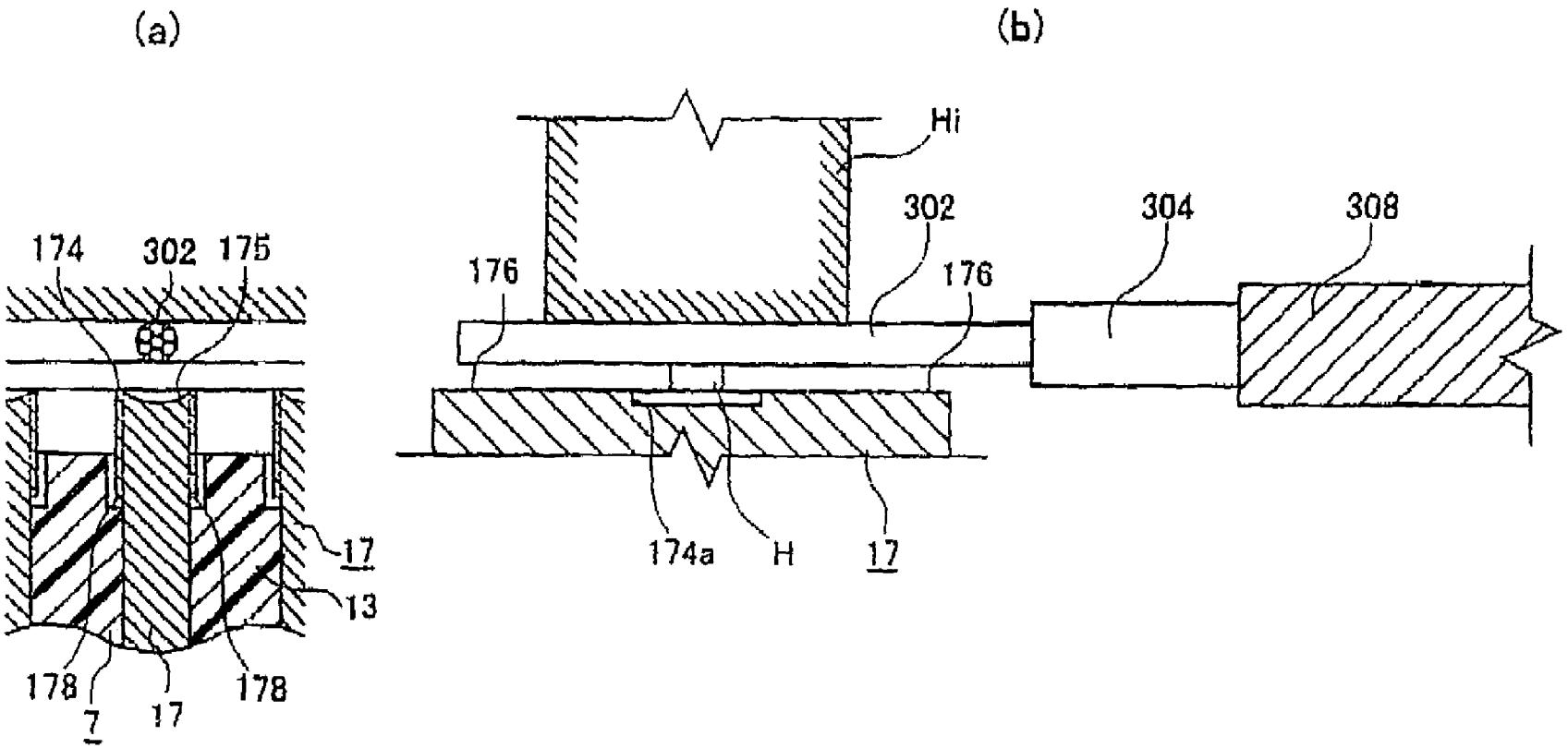
FIG. 22 is a longitudinal sectional view of a selected portion and a transverse sectional view of a selected portion of FIG. 19 shown together, in which part (a) is the longitudinal sectional view and part (b) is the transverse sectional view.
Figure 23:
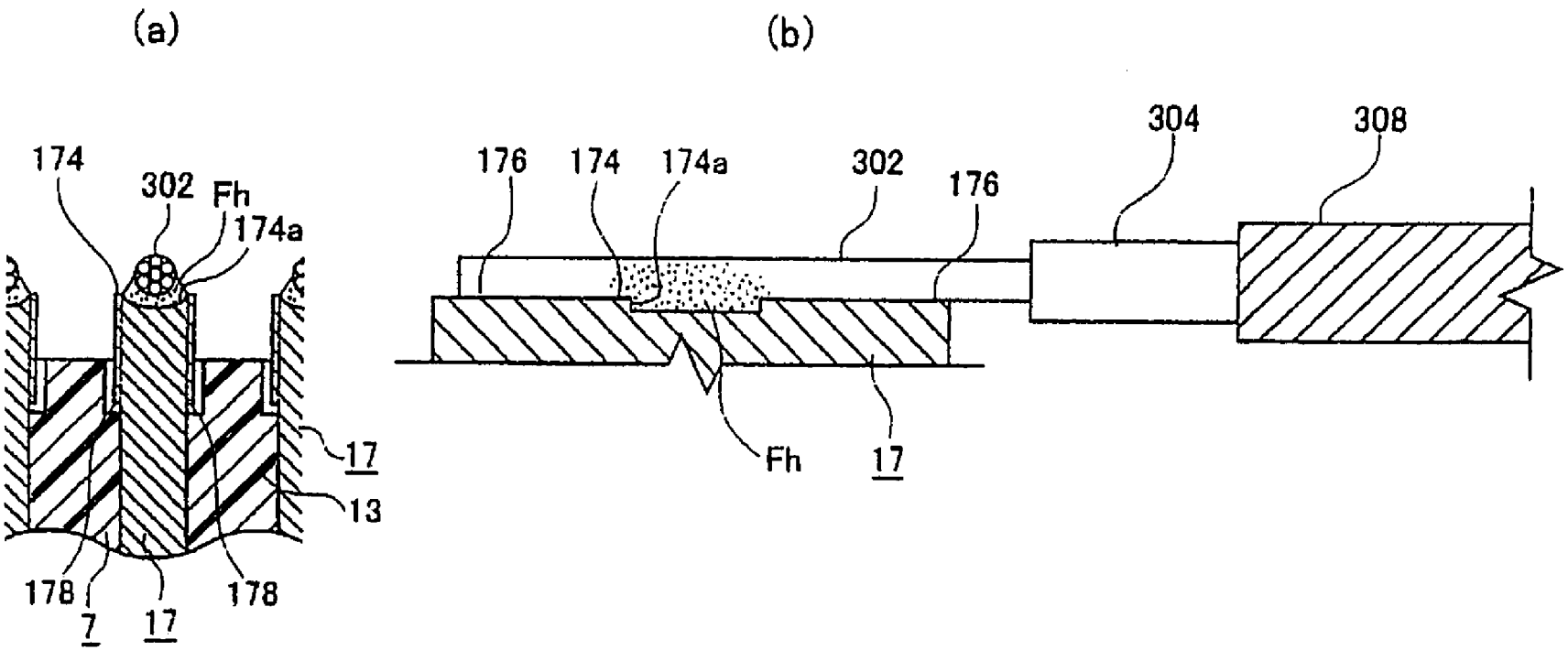
FIG. 23 is a sectional view of a selected portion and a transverse sectional view of a selected portion of FIG. 20 shown together, in which part (a) is the longitudinal sectional view and part (b) is the transverse sectional view.
Figure 24:
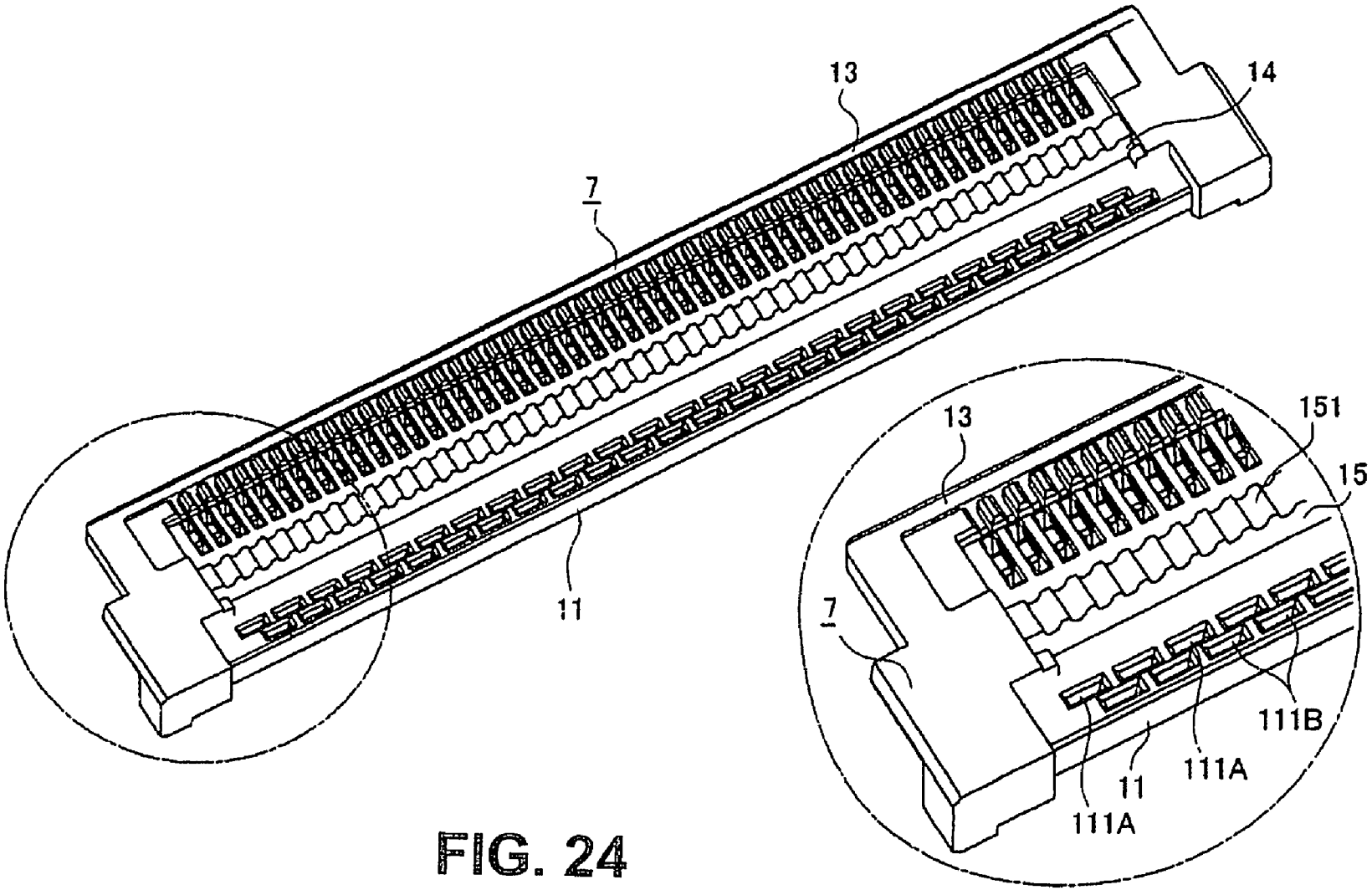
FIG. 24 is a perspective view of the housing, and an enlarged view of the of the essential portion thereof.
Figure 25:
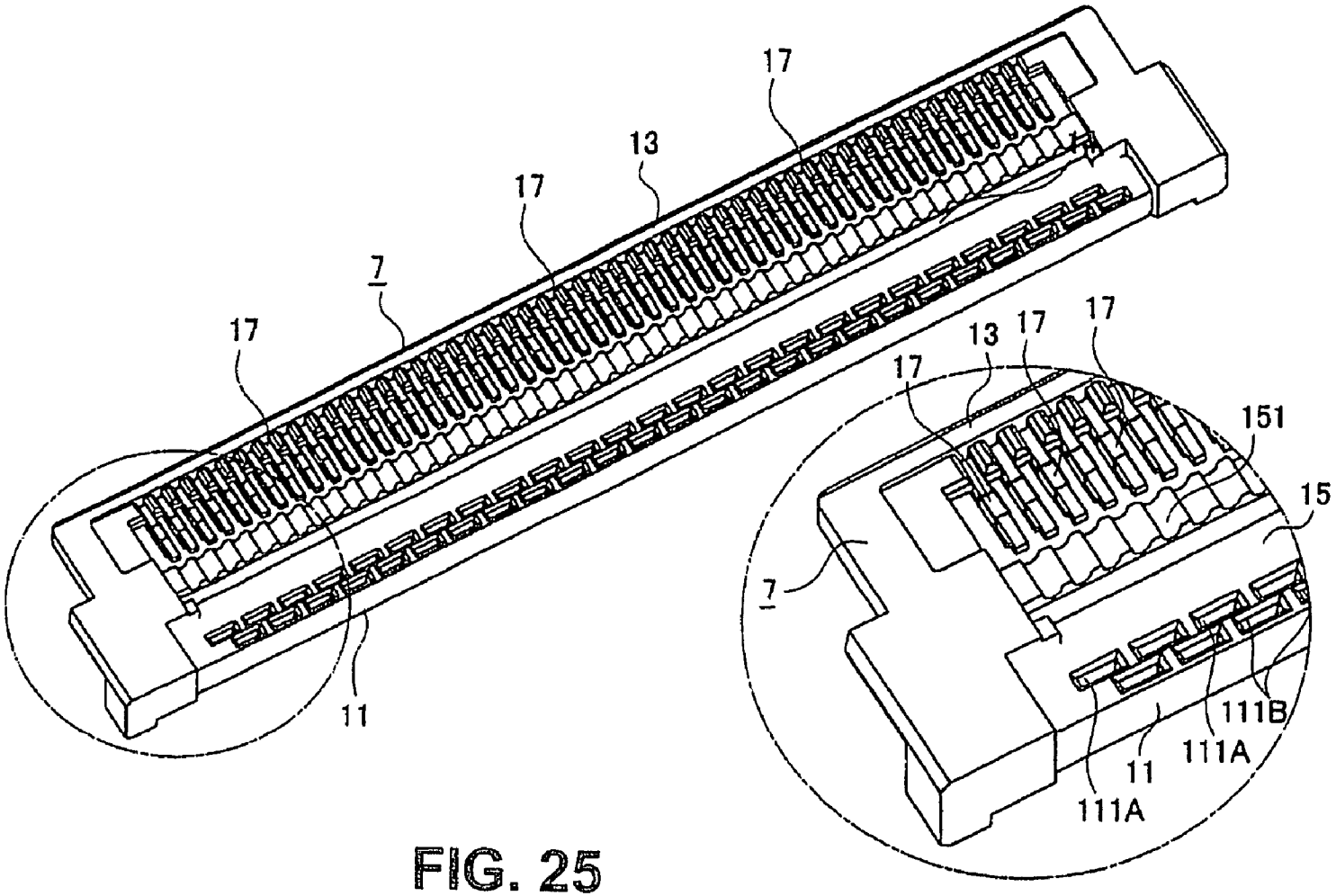
FIG. 25 is a perspective view showing a state in which the terminal is attached to the housing of FIG. 24, and an enlarged view of the essential portion thereof.

Next, as shown in FIGS. 19 & 22, the solder fusing device Hi is placed on the inner conductor 302 and subjected to heating, thus melting the solder. This illustrates the soldering procedure of step (2). As shown in FIGS. 20 & 23, the fused solder H enters the depression 174*a* where it forms a fillet Fh (gradation portion), and the soldering is complete. This illustrates the procedure of step (3).

Figure 27:
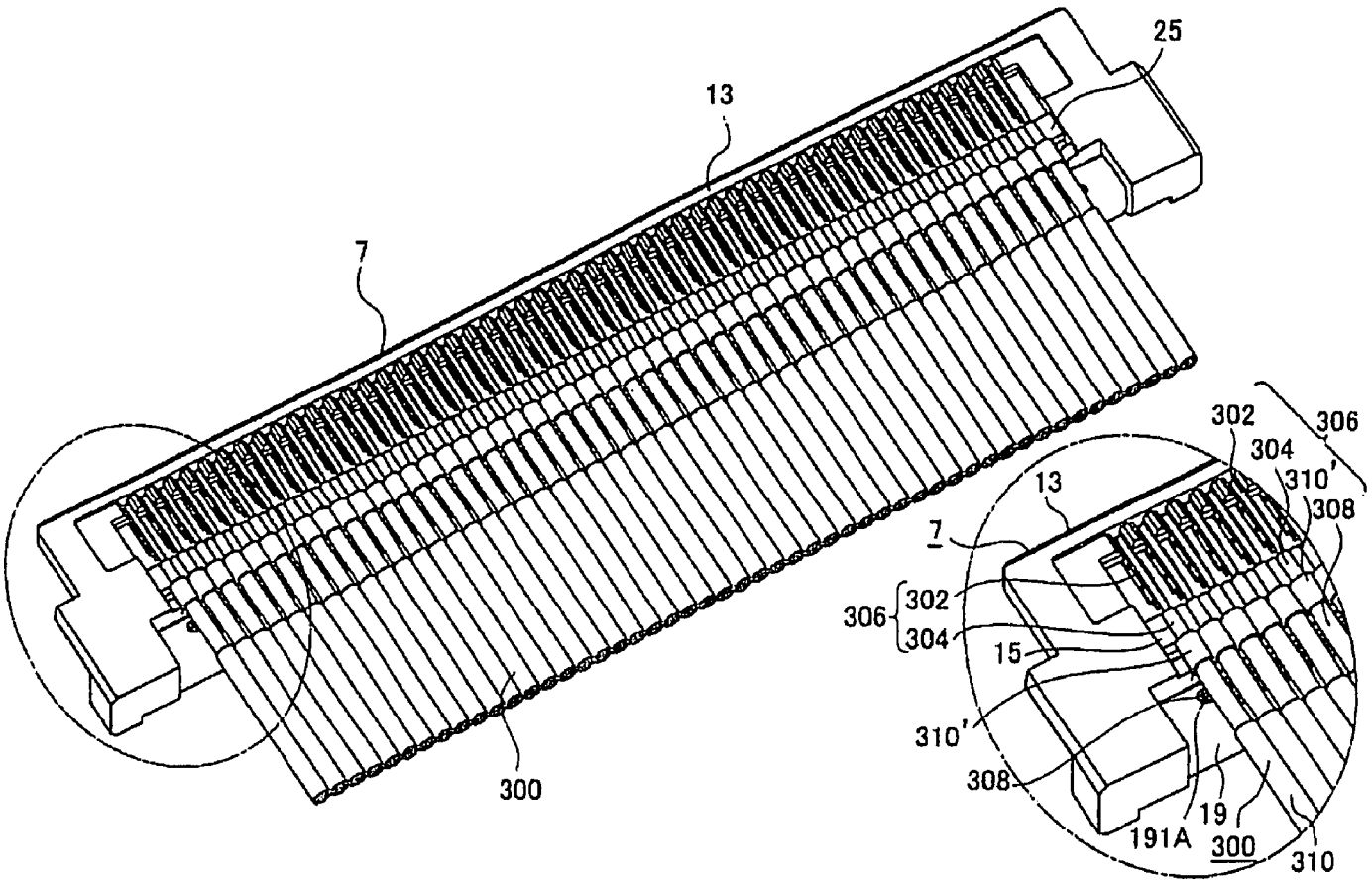
FIG. 27 is a perspective view showing a state in which the coaxial cable is attached to the housing of FIG. 26, and an enlarged view of the essential portion thereof.
Figure 28:
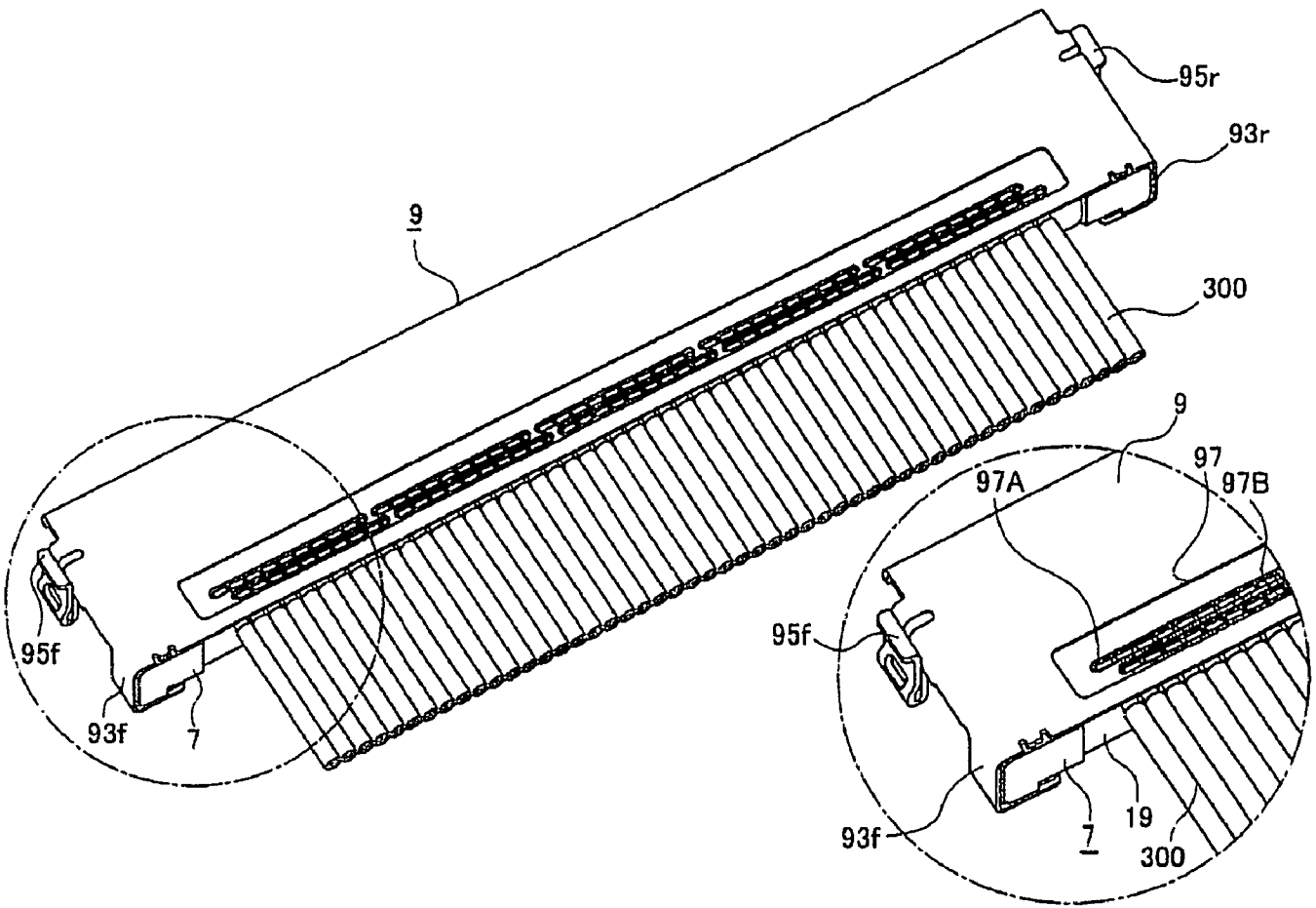
FIG. 28 is a perspective view showing a state in which a shell is attached to the housing of FIG. 27, and an enlarged main portion view of the essential portion thereof.
Figure 29:
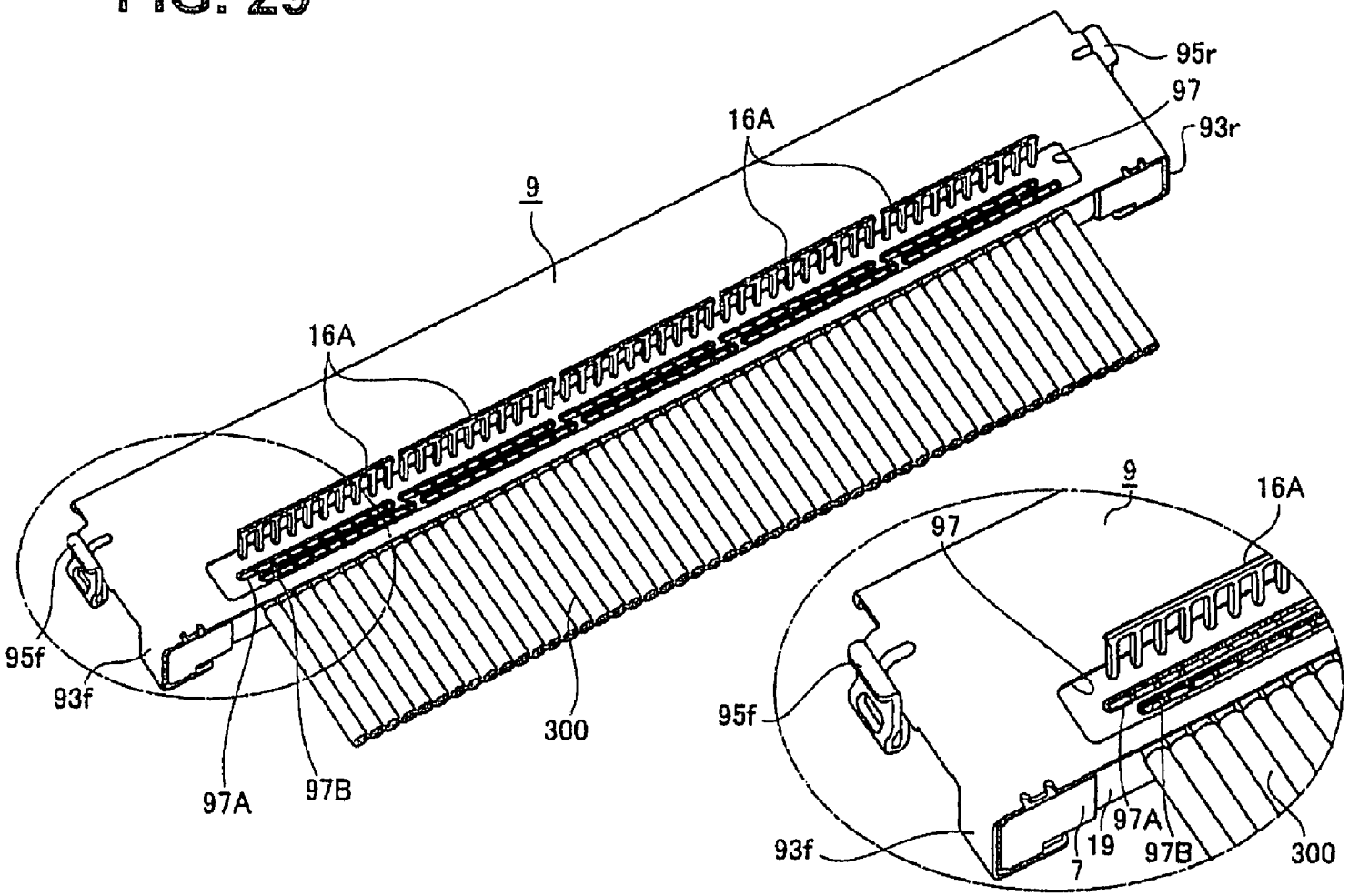
FIG. 29 is a perspective view showing a state immediately prior to mounting to the housing of FIG. 28 a cable holder for holding an odd-numbered coaxial cable as counted from the left side of the drawing, and an enlarged view of a selected portion thereof.
Figure 30:
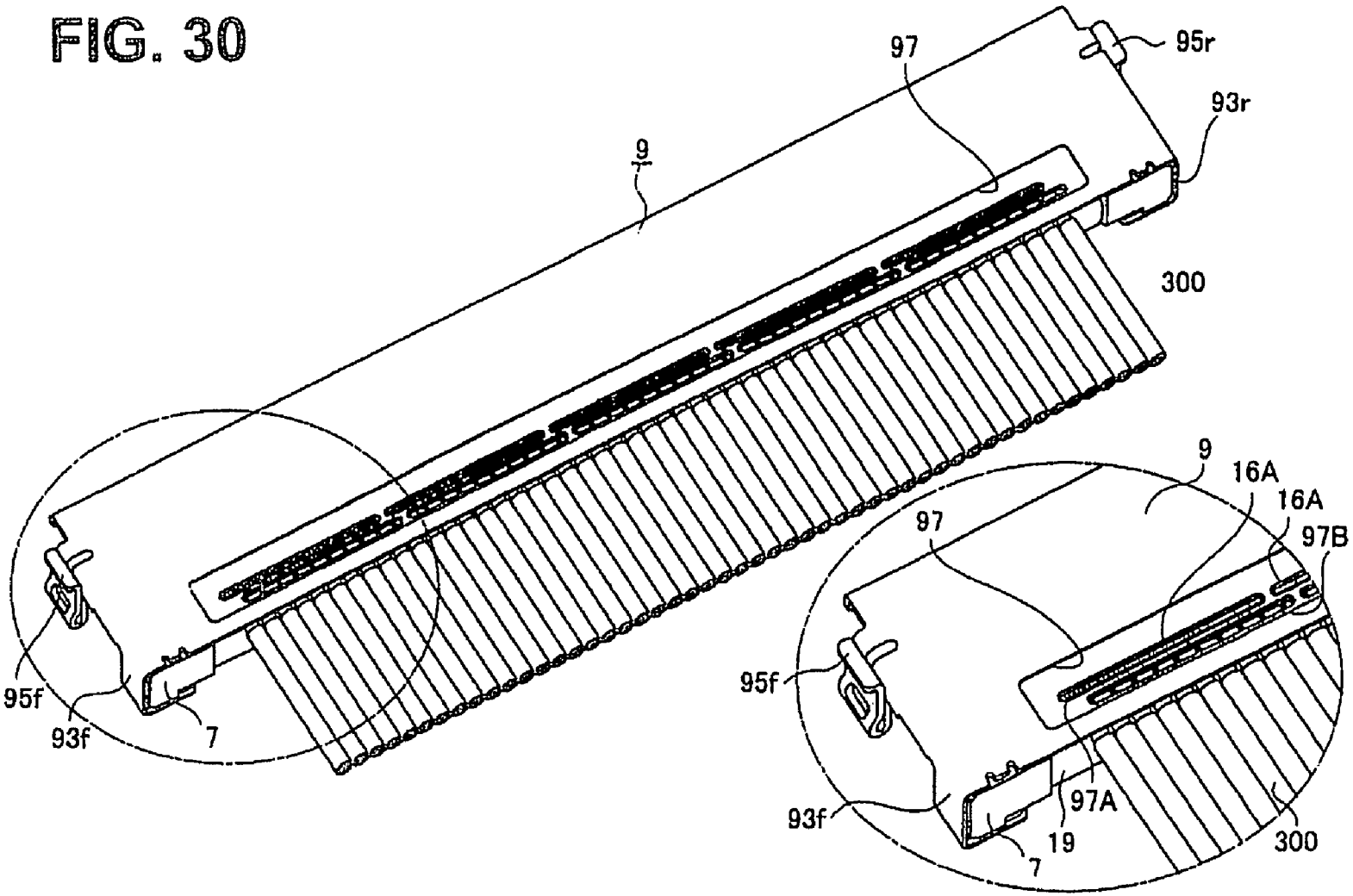
FIG. 30 is a perspective view showing a state immediately after mounting the cable holder of FIG. 29 to the housing, and an enlarged view of a selected portion thereof.
Figure 31:
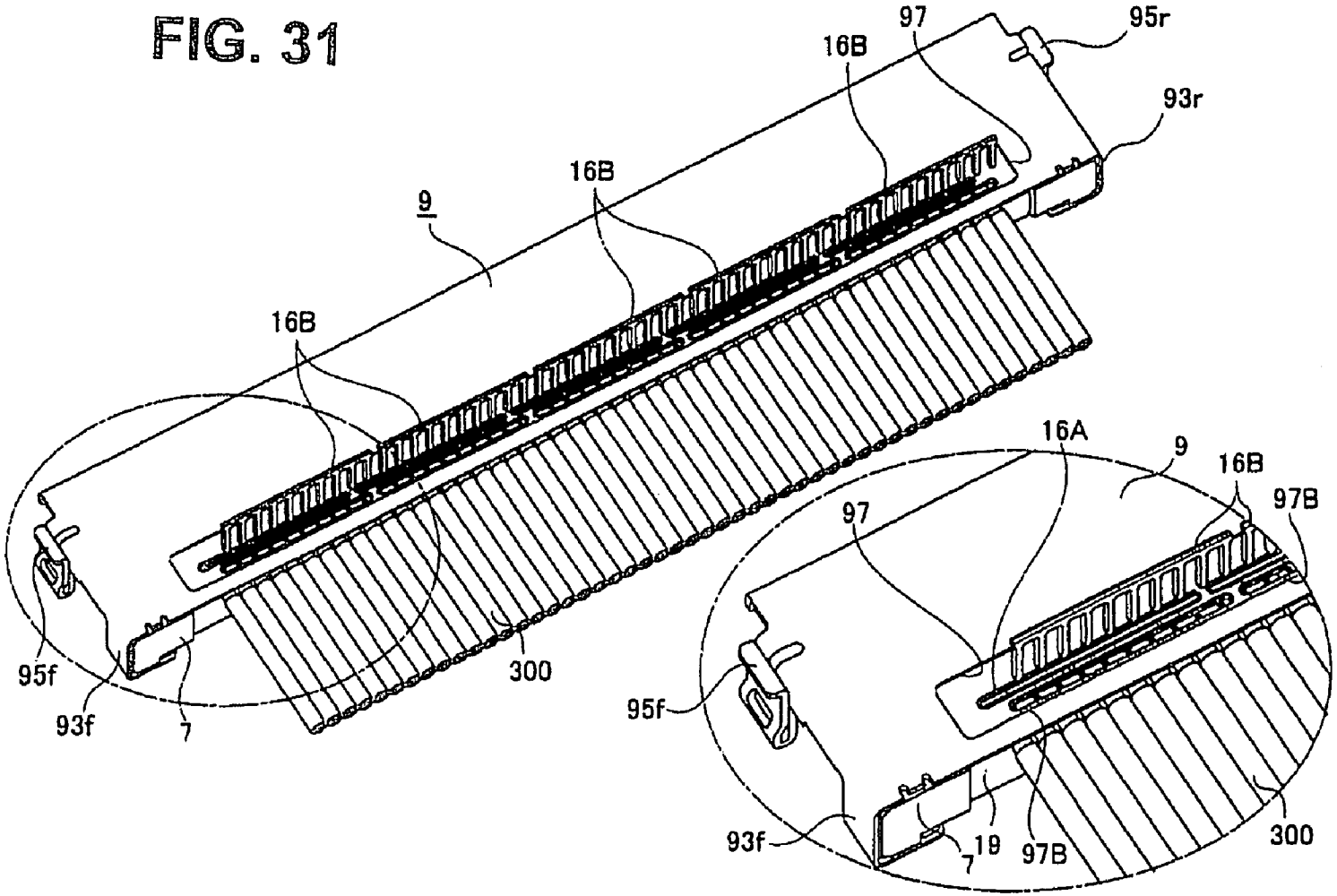
FIG. 31 is a perspective view showing a state immediately prior to mounting to the housing of FIG. 30 a cable holder for holding an even-numbered coaxial cable as counted from the left side of the drawing, and an enlarged view of a selected portion thereof.
Figure 32:
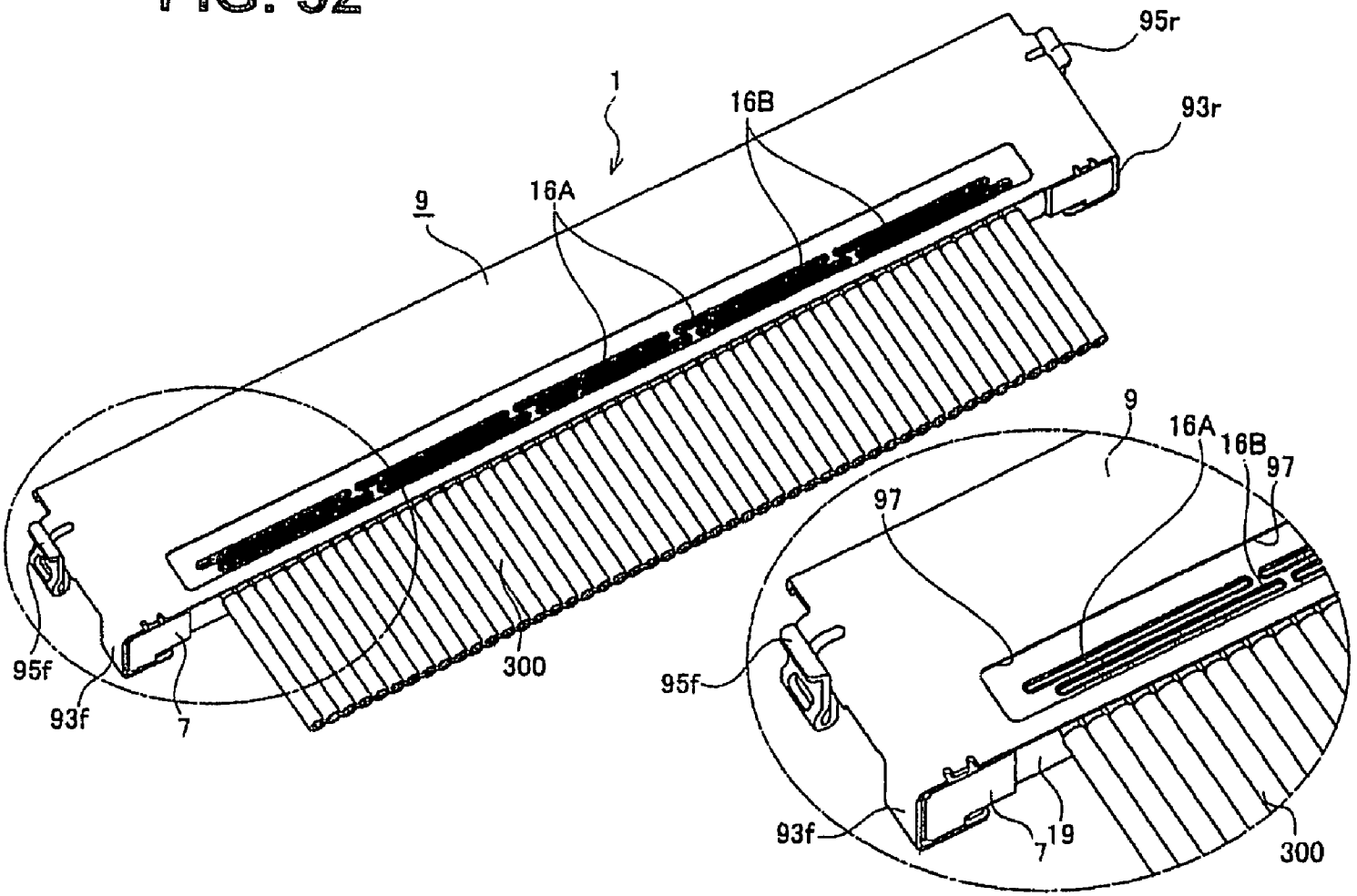
FIG. 32 is a perspective view showing a state immediately after mounting the cable holder of FIG. 31 to the housing, and an enlarged view of a selected portion thereof.

By a further procedure, namely step (4), the housing 7 with coaxial cables 300 soldered to the terminals 17 is covered with the shell 9, which typically is a metal cover or otherwise strong and durable cover. This is illustrated in FIGS. 27-28. Thereafter, according to step (5), the cable holder 16A is inserted into the through hole 97A, the through hole 191A, and the cable holder fitting hole 111A. FIGS. 5, 7, 8, 29, 30 & 33-34 illustrate this. Step (6) inserts the cable holder 16B into the through hole 97B, the through-hole 191B, and the cable holder fitting hole 111B. FIGS. 7, 9 & 31-32 illustrate this procedure.

The mating connector 2 is described with reference to FIGS. 1, 2 & 5-6. The mating connector 2 has a mating housing 21 formed of synthetic resin or other insulating resin. Mating terminals 27 are fitted on the mating housing 21 and brought into contact with the terminals 17 of the connector 1 upon fitting engagement between the connector 1 and the mating connector 2 (FIG. 5) and a mating shell 29 covering the mating housing 21.

The shape of the mating housing 21 is that of an elongated rectangle in plan view, which also is the shape of the housing 7. Further, the mating housing 21 has mating terminal insertion portions 23 into which the mating terminals 27 are inserted and which are provided parallel to one another in the longitudinal direction (left-to-right direction) in the same number as that of the mating terminals 27 (see FIGS. 1 and 5). Further, as can be seen in FIG. 1, formed on either side of the rear edge portion of the mating housing 21 is a locking protrusion 211 for mounting the mating shell 29 FIG.

Preferably, the mating terminal 27 is formed by machining a thin metal plate. As can be seen from FIGS. 5 & 6, the mating terminal 27 has a main portion 271 having a substantially horizontal E-shaped configuration and an extending portion 273 having a substantially horizontal L-shaped configuration, with the main portion 271 and the extending portion 273 being connected in series in the front-to-rear direction. Further, the main portion 271 is provided with a press-fitting member 271*a* so that the mating terminal 27 is attached to the mating housing 21 by press-fitting the main portion 271 of the mating terminal 27 into the mating terminal insertion portion 23 of the mating housing 21 for fixation. A press-fitting hole 23*a* is provided in the mating terminal insertion portion 23 in an opposing relation to the press-fitting member 271*a*. (FIGS. 5 & 6.)

In the extending portion 273, the terminal 17 is fitted inside a space S defined by the extending portion 273 upon connecting the connector 1 and the mating connector 2 together (FIGS. 5-6). Further, the distal end of the extending portion 273 is formed as a protruding distal end portion 273*a* bent toward the terminal 17 side. Electrical connection is established between the connector 1 and the mating connector 2 as the distal end portion 273*a* comes into contact with the rear upright leg 171*r* of the terminal 17 of the connector 1.

The mating shell 29 serves to mount the connector 1 and the mating connector 2 to each other as the mating shell 29 is coupled with the shell 9 of the connector 1. The mating shell 29 covers the front edge and opposite side portions of the mating housing 21. A regulation plate 291, which serves to guide the connector 1 or prevent push-back of the connector 1 as it is brought into mating engagement with the mating connector 2, is provided upright in the front edge portion of the mating connector 2. Provided on opposite sides of the regulation plate 291 are cover portions 293*f*, 293*r* covering the opposite side portions of the mating housing 21 (FIGS. 1-2)

The cover portions 293*f*, 293*r* are provided with engaging holes 295*f*, 295*r* engaging with the locking members 95*f*, 95*r* of the shell 9, respectively (FIGS. 1-2). The size of the engaging holes 295*f*, 295*r* in the width direction (left-to-right direction) is somewhat larger than the thickness dimension of the locking members 95*f*, 95*r* of the shell 9 in the state when the locking members 95*f*, 95*r* are not applied with an external force and hence their opening is not closed. Further, the distance between the engaging holes 295*f*, 295*r* is set to be slightly smaller than the distance between the locking members 95*f*, 95*r*. In addition, formed in the rearward surface of each of the cover portions 293*f*, 293*r* is an engaging hole 297 to be engaged with the locking protrusion 211 of the mating housing 21. To mount the illustrated connector 1 and the mating connector 2 together, the connector 1 is attached from above the mating connector 2 (FIGS. 1, 2 & 5-6.)

At this time, the connector 1 and the mating connector 2 are aligned in their orientations such that the locking members 95*f*, 95*r* of the connector 1 enter the engaging holes 295*f*, 295*r*, respectively, of the mating connector 2. Since the engaging holes 295*f*, 295*r* are larger in their width direction (left-to-right direction) than the thickness dimension of the locking members 95*f*, 95*r* of the shell 9 at the time when no external force acts on the locking members 95*f*, 95*r*, the locking members 95*f*, 95*r* are easily pushed into the engaging holes 295*f* 295*r*, respectively. Because the distance between the engaging holes 295*f*, 295*r* is set to be slightly smaller than the distance between the locking members 95*f* 95*r*, upon mounting the connector 1 and the mating connector 2 to each other, the locking members 95*f*, 95*r* of the connector 1 are each applied with an external force from the mating connector 2 which acts to close its opening. As a result, a resilient force develops in the locking members 95*f*, 95*r*, which serves to prevent dislodging of the locking members 95*f*, 95*r* from the engaging holes 295*f*, 295*r*, respectively. Accordingly, the connector 1 and the mating connector 2 are combined together with firm connection being established between the connector 1 and the mating connector 2.

The operation and effects of the connector constructed as described above now are described. Because the depression 174*a* is formed in the terminal 17 of the connector 1, the fused solder H is received within the depression 174*a*. Accordingly, the majority of the fused solder H forms the fillet Fh within the depression 174*a* without spreading to the periphery of the depression 174*a* (see FIGS. 18 through 23). Thus, as compared with the case of conventional terminals with no such depression 174*a* provided in the soldering region 174 (FIG. 35*b*), there is relatively little or no spreading of the solder H over the surface of the terminal 17 (see FIG. 35(*a*)). Due to the formation of the fillet Fh in the depression 174*a*, the connection between the terminal 17 and the fillet Fh becomes a three-dimensional one, causing an increase in connection surface area and/or volume, whereby the terminal 17*a* takes on a configuration as if a root has grown between the conductor 302 and the terminal 17 (see FIG. 23).

Further, as seen in cross-section in FIG. 3, the depression 174*a* has an arcuate bottom surface, whereby the bottom surface contacts the fused solder over a large contact area, larger for example than compared with the ordinary flat extent of the termination surface. This makes it possible to achieve an enhanced connection force between the terminal 17 and the inner conductor 302.

Figure 35:
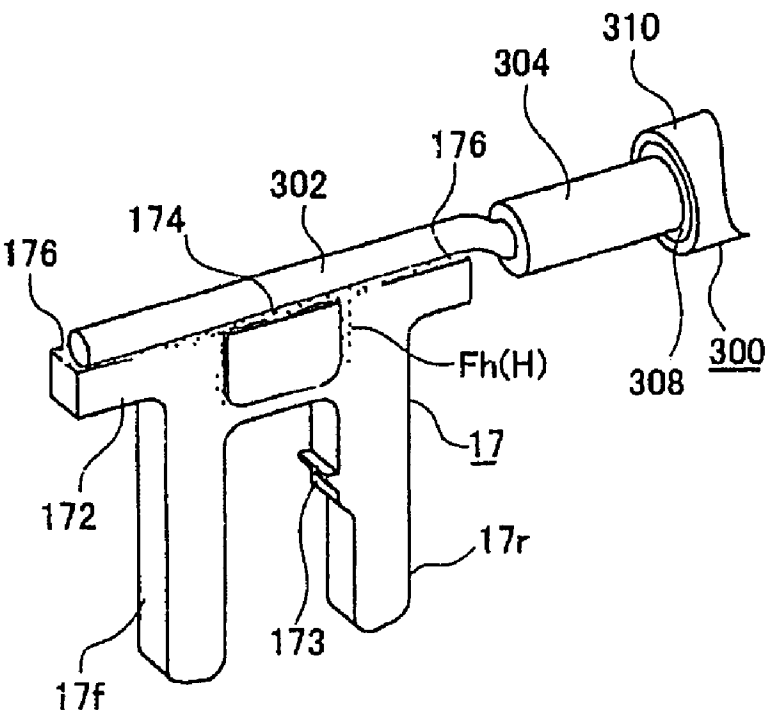
FIG. 35 is a diagram showing the terminal according to the present invention as compared with a conventional terminal having no depression and stepped portion, in which part (a) shows the terminal according to the present invention, and part (b) shows the conventional terminal.
Figure 35:
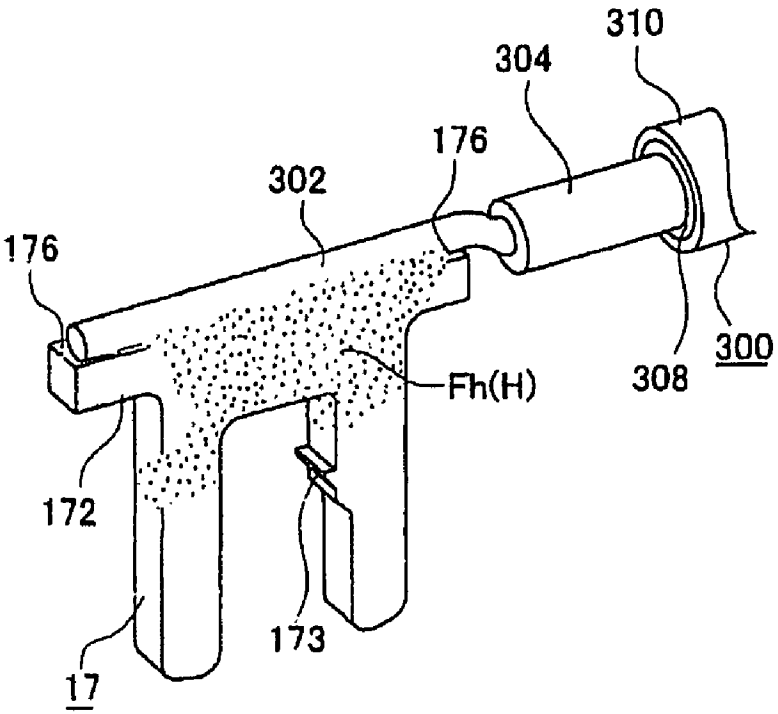

Further, the sidewall stepped portion 179, when provided, is an island-like region formed in the connector 1 that further accommodates excess solder should such be needed to prevent unwanted solder migration. With this arrangement, even when a somewhat large amount of fused solder H is present, as shown in FIG. 35(*a*), the fused solder H spreads toward and around the periphery of the stepped portion 179, whereby, as compared with the case where no stepped portion 179 is formed as shown in FIG. 35(*b*), the fused solder H is prevented from unnecessarily spreading toward the other side surface region 175. As a result, solder is prevented from flowing into the portions of the rear upright leg 171*r* which comes into contact with the distal end portion 273*a* of the mating terminal 27.

It will be appreciated that the fillet Fh provides excellent strength to the connection between the inner conductor 302 and the coaxial cable 300. As a result of the controlled shaping of the fillet during its formation, the strength of the force with which the inner conductor 302 of the coaxial cable 300 is connected to the terminal 17 through the fillet Fh can be retained even when the width dimension of the fillet Fh is reduced. Therefore, the width dimension of the terminal 17 can be reduced while maintaining the connection force between the terminal 17 and the inner conductor 302 without having to modify the conductor 302.

Further, in the connector 1, the fitting holes 111A, 111B into which the cable holders 16A, 16B are respectively fitted are provided in the housing 7, and the through-holes 97A, 97B respectively opposed to the fitting holes 111A, 111B are provided in the shell 9.

When the cable holders 16A, 16B are fitted into the fitting holes 111A, 111B via the through-holes 97A, 97B, respectively, the cable holders 16A, 16B are received within the housing 7 in a state of straddling and nipping the coaxial cables 300, whereby no soldering is required to hold the coaxial cables 300 onto the housing 7.

When the cable holders 16A, 16B are fitted into the cable holder fitting holes 111A, 111B via the through holes 97A, 97B, respectively, of the shell 9, the substrate portion or backbone 16*a* is located within the through holes 97A, 97B (see FIGS. 5, 6, 8 and 9). Comparing this structure with that of the case where the cable holders 16A, 16B are fitted into the cable holder fitting holes 111A, 111B of the housing 7 and then the housing 7 is covered with a shell having no through-holes 97A, 97B, respectively, provided that the length of the legs or tines 16*b* of the cable holders 16A, 16B, and also provided that the insertion amount of the legs or tines 16*b* into the cable holder fitting holes 111A, 111B are the same between the two structures, the cable holders 16A, 16B of the connector 1 have their respective substrate portions or backbones 16*a* exposed and located within the through holes 97A, 97B of the shell 9, whereby the height dimension of the connector 1 can be reduced correspondingly.

Figure 36:
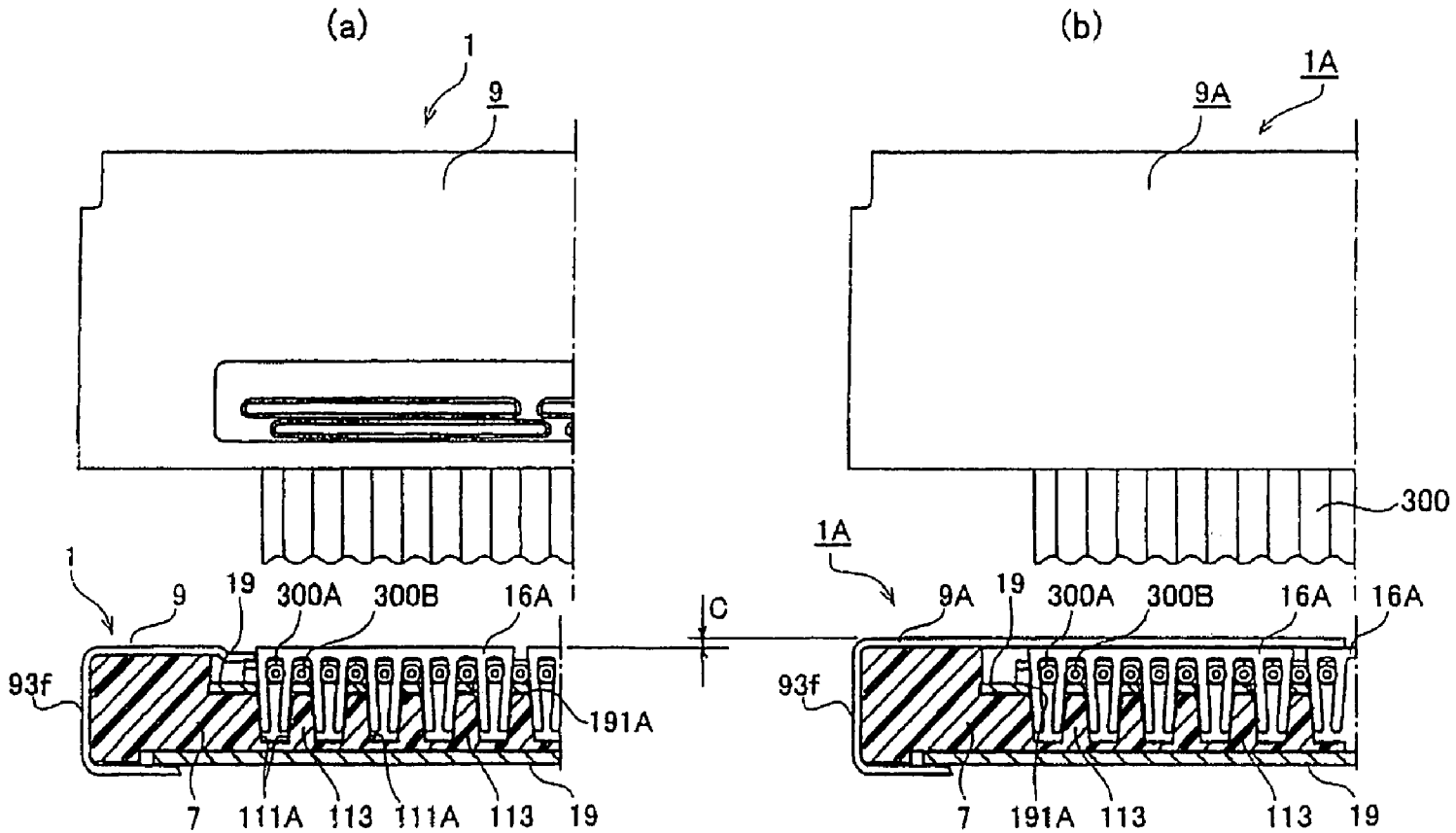
FIG. 36 is a diagram for explaining the effect of forming a through-hole in the shell of the connector according to the present invention as compared with the case where no such through-hole is provided, in which part (a) shows the shell according to the present invention, and part (b) shows a shell with no through-hole.
Figure 37:
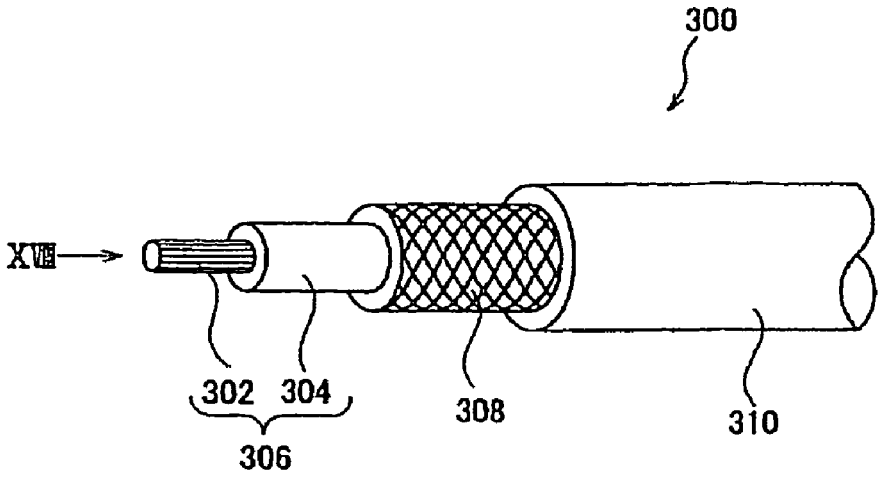
PRIOR ART FIG. 37
FIG. 37 is a perspective view of a coaxial cable.
Figure 38:
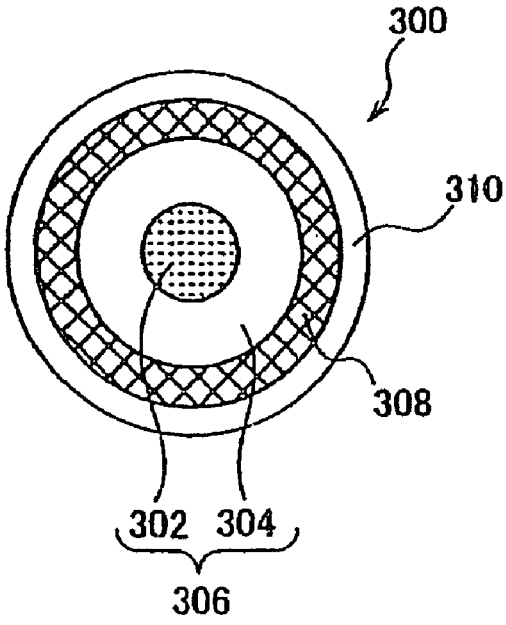
FIG. 38 PRIOR ART
FIG. 38 is an enlarged transverse cross-sectional view of the coaxial cable shown in FIG. 37.
Figure 39:
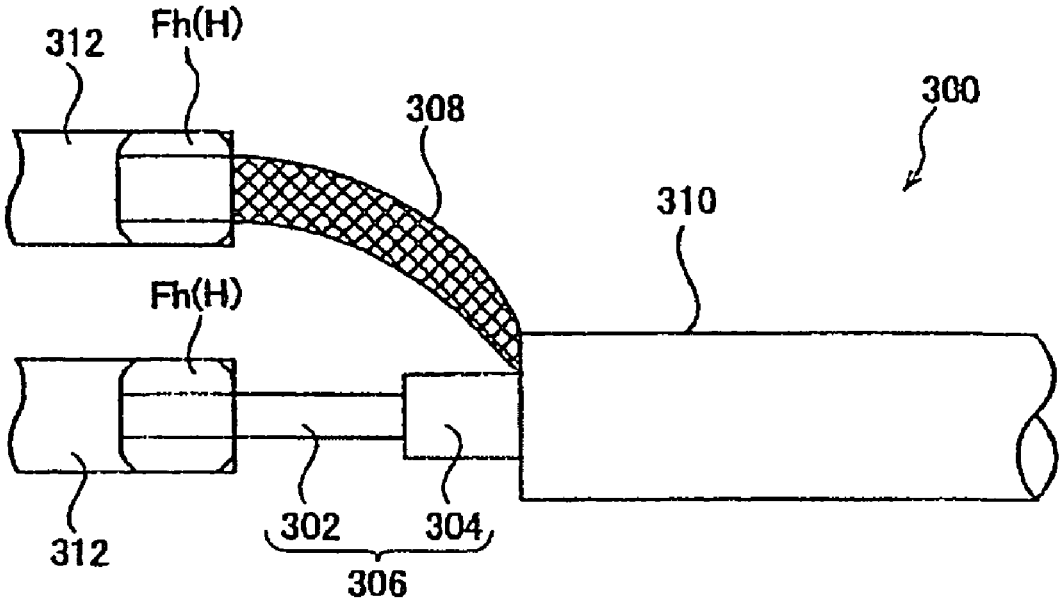
PRIOR ART FIG. 39
FIG. 39 is a diagram illustrating a state in which the coaxial cable of FIG. 37 is soldered onto a terminal.

FIG. 36 illustrates an actual comparative example, wherein FIG. 36(*a*) shows the shell 9 according to this embodiment, and FIG. 36(*b*) shows a connector 1A to which a shell 9A having no through-holes is applied. It can be appreciated from the drawings that the height dimension is reduced by a dimension C, that is by an amount corresponding to the thickness of the substrate portion or backbone 16*a* of the cable holder 16A, 16B which is exposed and located within the through-hole 97A, 97B of the shell 9. It is to be noted that the same reference numerals are used to denote the same or like components in FIGS. 36(*a*) and 36(*b*).

Further, the connector 1 holds the coaxial cables 300 onto the housing 7 by using the cable holders 16A, 16B, and the coaxial cables 300 are very suitably and securely held in place onto the housing 7 without requiring any soldering.

This feature prevents hardening of electric wires due to solder wicking. Furthermore, as counted from one end (the left side in FIG. 4) of the large number of coaxial cables 300 arranged in parallel into a flat configuration, the odd-numbered coaxial cables 300A and the even-numbered coaxial cables 300B are held by different cable holders, namely the odd-numbered cable holders 16A and the even-numbered cable holders 16B, respectively. The cable holders 16A, 16B each can be arranged parallel in the front-to-rear direction but offset in the left-to-right direction with respect to one another, whereby the odd-numbered cable holders 16A reliably hold solely the odd-numbered coaxial cables 300A and the even-numbered cable holders 16B reliably hold solely the even-numbered coaxial cables 300B. Accordingly, it is possible to ensure that there is no single coaxial cable 300 that is insufficiently retained.

Further, the width W2 of the cable holder fitting holes 111A, 111B is substantially the same as the width W1 between adjacent legs 16*b*, and the cable holder fitting holes 111A, 111B are hole portions each shaped like an inverted truncated isosceles triangle and tapered such that its width is large at the top and small at the bottom. Therefore, as the respective legs or tines 16*b* of the cable holders 16A, 16B are inserted into the cable holder fitting holes 111A, 111B of the housing 7, the deeper the cable holders 16A, 16B are inserted into the cable holder fitting holes 111A, 111B, respectively, the narrower is the gap between the two legs or tines of the respective double-legged or double-tined portions of the cable holders 16A, 16B , leading to a corresponding increase in the force for holding the coaxial cable 300 sandwiched between the two legs or tines of the double-legged or double-tined portion.

Accordingly, connection reliability for the cables 300 is thus enhanced. Every single one of the coaxial cables 300 can be reliably grasped by pinching or nipping action solely by inserting the cable holders 16A, 16B into the cable holder fitting holes 111A, 111B, respectively. Furthermore, mechanical connection is effected on the coaxial cables 300 such that each coaxial cable 300 is sandwiched from above and below by the substrate portion or backbone 16*a* of each of the cable holders 16A, 16B and the ground bar 19, respectively, and such that the pair of legs or tines 16*b*, 16*b* constituting the double-legged or double-tined portion sandwich the coaxial cable 300 from the left and right sides. Further, as described above, upon inserting the cable holders 16A, 16B into the cable holder fitting holes 111A, 111B, respectively, the outer conductor 308 of the coaxial cable 300 is sandwiched from below and above by the ground bar 19, which is in contact with the shell 9 through both of its side arms 93*f*, 93*r* and the cable holders 16A, 16B, respectively, for electrical connection. (FIGS. 5, 6, 8 & 33-34.) Therefore, the cable holders 16A, 16B can effect both electrical and mechanical connections of the coaxial cable 300 at the same time, thereby achieving an improvement in operability. In addition, while the coaxial cable connector exemplified in this embodiment is the coaxial cable (braided coaxial cable) including the outer conductor covering the signal line 306 and consisting of the large number of spirally wound or braided electric wires, as long as it is used solely for soldering the terminal 17, a coaxial cable of a so-called semi-rigid structure whose outer conductor is made of a copper tube, or a so-called discrete cable other than the coaxial cable, also may be used.

It will be understood that the embodiments of the present invention which have been described are illustrative of some of the applications of the principles of the present invention. Numerous modifications may be made by those skilled in the art without departing from the true spirit and scope of the invention. Various features which are described herein can be used in any combination and are not limited to procure combinations that are specifically outlined herein.

The invention claimed is:

1. A connector for connecting coaxial cables to a circuit board, each of the cables having an inner conductor, an insulator between same and an intermediate conductive shield, and an outer insulative covering, the connector comprising:

an insulative housing supporting a plurality of conductive terminals, said housing including a body portion and a plug portion that extends away from the body portion, each of the terminals including a body portion supported by said housing body portion, each of the terminals further including at least one contact portion supported by said housing plug portion;

said terminals being supported by said housing body portion in side-by-side order, and said cables also being arranged in side-by-side order, portions of said cable shields being exposed;

at least first and second elongated cable holders extending perpendicularly to axes of said cables and electrically interconnecting selected cables together, said first cable holder having a first pair of cable shield-engaging tines arranged in side-by-side order, said second cable holder having a second pair of cable shield-engaging tines also arranged in side-by-side order, said first and second cable holders being offset from each other in a left-to-right direction so that said first cable holder engages only odd-numbered cables and said second cable holder engages only even-numbered cables; and, a conductive shell supported by said housing body portion, the shell including at least first and second openings disposed therein, said first and second elongated cable holders being respectively received in said first and second openings.

2. The connector of claim 1, further including a ground bar supported by said housing, the ground bar having a plurality of first and second openings disposed therein, said first openings and said second openings being offset from each other in side-by-side order for receiving tines of said respective first and second cable holders.

3. The connector of claim 1, further including a ground bar supported by said housing, the ground bar being spaced apart from said cable shields, said ground bar including a plurality of openings disposed therein, and said ground bar openings receive tines of said cable holders.

4. The connector of claim 1, wherein said cable holders include a backbone supporting said pair of tines which project therefrom to define a cantilevered double-tined portion that straddles and grasps one of said cables by a pinching action.

5. The connector of claim 1, further including a conductive shell supported by said housing body portion, the shell including an opening disposed therein, further including a ground bar supported by said housing, the ground bar including an opening disposed therein, said shell being spaced apart from said ground bar and receives one of said cables therebetween, and said cable holder is positioned through said shell opening, and the cable holder pair of tines grasps one of said cables and is positioned through said ground bar opening such that said cable is connected to each of said shell, said cable holder and said ground bar.

6. The connector of claim 5, wherein said cable holder includes a backbone from which said pair of tines extends, said opening of the shell is a slot that accommodates said cable holder backbone so that the cable holder does not project substantially beyond said shell so as to minimize the height of the connector.

7. The connector of claim 4, wherein said pair of tines have one end fixed to the backbone and the other end free so as to provide the cantilevered double-tined portion.

8. The connector of claim 5, wherein said shell includes a plurality of said openings which include odd-numbered through holes arranged in side-by-side order and even-numbered through holes arranged in side-by-side order, said ground bar includes a plurality of said openings which include odd-numbered openings arranged in side-by-side order and even-numbered openings arranged in side-by-side order, said odd-numbered shell through holes and said odd-numbered ground bar openings being in front-to-rear alignment with each other, and said even-numbered shell through holes and said even-numbered ground bar openings being in front-to-rear alignment with each other.

9. The connector according to claim 8, wherein said first set of cable holders is in front-to-rear alignment with said odd-numbered through holes and with said odd-numbered ground bar openings and serves to hold odd-numbered ones of said cables, and a second set of the cable holders serves to hold the even-numbered cables, and wherein said second set of cable holders is in front-to-rear alignment with said even-numbered through holes and with said even-numbered ground bar openings and serves to hold even-numbered ones of said cables.

10. The connector according to claim 1, wherein said cable holder further includes a backbone from which the pair of tines depends, said insulative housing includes a plurality of fitting holes including a first fitting hole that receives said first pair of cable holder tines and a second fitting hole that receives said second pair of cable holder tines, and said fitting holes in the housing each have walls that taper toward each other in the direction away from the cable holder backbone of the respective pair of tines received therein so that said pair of tines closes to pinch said cable therebetween.

11. The connector according to claim 10, further including a conductive shell supported by said housing body portion, the shell including at least first and second through holes disposed therein, wherein the housing fitting holes and the shell through holes are parallel in an extending direction, and offset in an orthogonal direction to the extending direction when the coaxial cables are fitted into the connector.

12. The connector according to claim 10, wherein spacing between outside surfaces of the first pair of tines and of the second pair of tines have a width (W1), and the tapered fitting holes in the housing include widths which include have an insertion width (W2), the spacing widths (W1) and the fitting hole insertion widths (W2) are substantially the same, the fitting hole widths tapering down from said insertion widths to a lesser width at their ends.

13. A connector for connecting coaxial cables to a circuit board, each of the cables having an inner conductor, an insulator between same and an intermediate conductive shield, and an outer insulative covering, the connector comprising:

an insulative housing supporting a plurality of conductive terminals, said housing including a plurality of inwardly tapering first and second fitting holes, a body portion and a plug portion that extends away from the body portion, each of the terminals including a body portion supported by said housing body portion, each of the terminals further including at least one contact portion supported by said housing plug portion;

said terminals being supported by said housing body portion in side-by-side order, and said wires also being arranged in side-by-side order, portions of said cable shields being exposed;

a conductive shell supported by said housing body portion, the shell including at least first and second through holes;

at least first and second elongated cable holders extending perpendicularly to axes of said cables and electrically interconnecting selected cables together, said first cable holder having a backbone and a first pair of cable shield-engaging tines extending therefrom, said second cable holder having a backbone and a second pair of cable shield-engaging tines extending therefrom, said first and second cable holders being offset from each other in a left-to-right direction so that said first cable holder engages only odd-numbered cables and said second cable holder engages only even-numbered cables; and said first and second elongated cable holders being respectively received in said first and second shell through holes, and said first and second pairs of tines thereof are received respectively within said first and second fitting holes so that said pair of tines closes to pinch said cable therebetween.

14. The connector according to claim 10, wherein said conductive shell includes at least first and second through holes disposed therein, wherein the housing fitting holes and the shell through holes are parallel in an extending direction, and offset in an orthogonal direction to the extending direction when the coaxial cables are fitted into the connector.

15. The connector of claim 13, further including a ground bar supported by said housing, the ground bar having a plurality of first and second openings disposed therein, said first openings and said second openings being offset from each other in side-by-side order for receiving tines of said respective first and second cable holders.

16. The connector of claim 13, further including a ground bar supported by said housing, the ground bar being spaced apart from said cable shields, said ground bar including a plurality of openings disposed therein, and said ground bar openings receive tines of said cable holders.

17. The connector of claim 13, further including a ground bar supported by said housing, the ground bar including an opening disposed therein, said shell being spaced apart from said ground bar and receives one of said cables therebetween, and said cable holder is positioned through one of said said shell through holes, and the cable holder pair of tines grasps one of said cables and is positioned through said ground bar opening such that said cable is connected to each of said shell, said cable holder and said ground bar.

18. The connector of claim 15, wherein said shell includes a plurality of said through holes which include odd-numbered through holes arranged in side-by-side order and even-numbered through holes arranged in side-by-side order, said ground bar includes a plurality of said openings which include odd-numbered openings arranged in side-by-side order and even-numbered openings arranged in side-by-side order, said odd-numbered shell through holes and said odd-numbered ground bar openings being in front-to-rear alignment with each other, and said even-numbered shell through holes and said even-numbered ground bar openings being in front-to-rear alignment with each other.

19. The connector according to claim 18, wherein said first set of cable holders is in front-to-rear alignment with said odd-numbered through holes and with said odd-numbered ground bar openings and serves to hold odd-numbered ones of said cables, and a second set of the cable holders serves to hold the even-numbered cables, and wherein said second set of cable holders is in front-to-rear alignment with said even-numbered through holes and with said even-numbered ground bar openings and serves to hold even-numbered ones of said cables.

20. A connector for connecting coaxial cables to a circuit board, each of the cables having an inner conductor, an insulator between same and an intermediate conductive shield, and an outer insulative covering, the connector comprising:

an insulative housing supporting a plurality of conductive terminals, said housing including a body portion and a plug portion that extends away from the body portion, each of the terminals including a body portion supported by said housing body portion, each of the terminals further including at least one contact portion supported by said housing plug portion;

said terminals being supported by said housing body portion in side-by-side order, and said cables also being arranged in side-by-side order, portions of said cable shields being exposed;

at least first and second elongated cable holders extending perpendicularly to axes of said cables and electrically interconnecting selected cables together, said first cable holder having a first pair of cable shield-engaging tines arranged in side-by-side order, said second cable holder having a second pair of cable shield-engaging tines also arranged in side-by-side order, said first and second cable holders being offset from each other in a left-to-right direction so that said first cable holder engages only odd-numbered cables and said second cable holder engages only even-numbered cables; and, each of said cable holders further includes a backbone from which the pair of tines depends, and said insulative housing includes a plurality of fitting holes, the fitting holes including a first fitting hole that receives said first pair of cable holder tines and a second fitting hole that receives said second pair of cable holder tines, said fitting holes including walls that taper toward each other in the direction away from the cable holder backbone of the respective pair of tines received therein so that said pair of tines closes to pinch said cable therebetween.

* * * * *